United States Patent [19]

Van Langenhoven

[11] 3,951,038

[45] Apr. 20, 1976

[54] AIR OPERATED PROJECTILE FIRING APPARATUS

[75] Inventor: Jules Edmond Van Langenhoven, Benton County, Ark.

[73] Assignee: Victor Comptometer Corporation, Chicago, Ill.

[22] Filed: July 7, 1965

[21] Appl. No.: 473,556

Related U.S. Application Data

[63] Continuation-in-part of Ser. No. 189,621, April 23, 1962, abandoned.

[30] Foreign Application Priority Data

May 3, 1961 Belgium ..... 606313

[52] U.S. Cl. ..... 89/7; 102/DIG. 5; 124/67

[51] Int. Cl.[2] ..... F47F 1/04

[58] Field of Search ..... 89/7, 1; 124/15, 11; 42/59, 14; 102/1, DIG. 5

[56] References Cited

UNITED STATES PATENTS

| | | | |
|---|---|---|---|
| 338,760 | 3/1886 | Merritt | 42/59 |
| 946,351 | 1/1910 | Haeghen | 42/59 |
| 1,045,373 | 11/1912 | Cook | 124/15 |
| 1,509,257 | 9/1924 | Randall | 124/15 |
| 2,435,647 | 2/1948 | Engseth | 103/153 |
| 2,572,176 | 10/1951 | Mihalyi | 124/15 |
| 2,574,147 | 11/1951 | Hobbs | 102/DIG. 5 |
| 2,872,851 | 2/1959 | Katz | 89/193 |
| 3,008,258 | 11/1961 | Johnson | 42/14 |
| 3,064,381 | 11/1962 | Vilbajo | 42/1 F |

FOREIGN PATENTS OR APPLICATIONS

| | | | |
|---|---|---|---|
| 3,833 | 1814 | United Kingdom | 102/DIG. 5 |
| 4,026 | 1816 | United Kingdom | 102/DIG. 5 |
| 5,317 | 1826 | United Kingdom | 102/DIG. 5 |
| 1,321,746 | 2/1963 | France | 89/7 |

*Primary Examiner*—David H. Brown
*Attorney, Agent, or Firm*—Bruce G. Klaas

EXEMPLARY CLAIM

47. A device for firing a projectile from a firing position comprising:

a barrel for guiding the projectile from the device, firing means operatively associated with the projectile in the firing position and being operative to fire the projectile through the barrel and being mounted in spaced relationship to the barrel, said firing means comprising an air cylinder and a firing chamber and an air flow passage connecting said cylinder to said firing chamber, one of said barrel and said firing means being axially movable relative to the other between a firing position and a loading position, a separate movable connecting member mounted between and in line with said barrel and said firing means and connecting said barrel to said firing means in the firing position, and means for moving said member transversely between the firing position in line with said barrel and a loading position spaced outwardly therefrom.

48 Claims, 32 Drawing Figures

INVENTOR.
Jules E. Van Langenhoven
BY
Karness, Dickey & Pierce
ATTORNEYS.

INVENTOR.
Jules E. Vanhangenhoven
BY
Harness, Dickey & Pierce
ATTORNEYS.

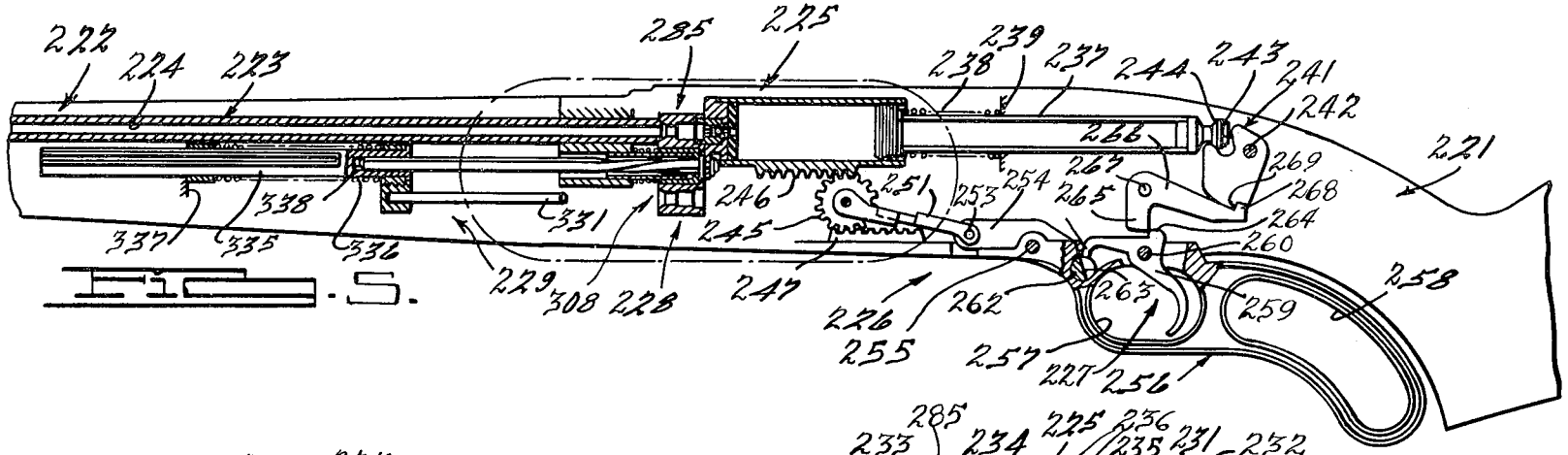
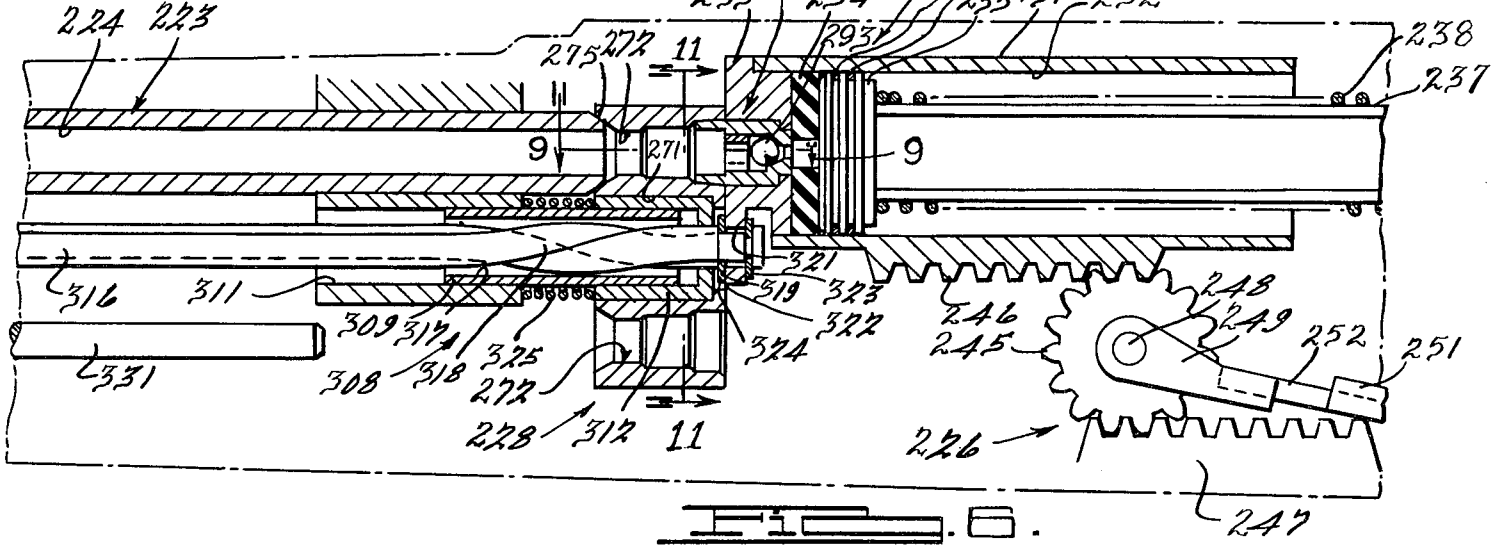
INVENTOR
BY Jules E. VanLangenhover
Harness, Dickey & Pierce
ATTORNEYS

INVENTOR.

Jules E. VanLangenhoven

BY

Thomas, Dicky & Pierce

ATTORNEYS.

INVENTOR
Jules E. VanLangenhoven
BY
Carness, Dickey & Pierce
ATTORNEYS

INVENTOR

Jules E. Vanlangenhoven

BY

Carmen, Dickey & Pierce

ATTORNEYS.

INVENTOR.
Jules E. Van Wangenhoven
BY
Harness, Dickey & Pierce
ATTORNEYS.

INVENTOR
Jules E. Van Langenhoven

BY Carness, Dickey & Pierce
ATTORNEYS.

INVENTOR
Jules E. Vanhangenhoven

BY Harness, Dickey & Pierce.
ATTORNEYS.

INVENTOR
Jules E. Van Langenhoven

BY Harness, Dickey & Pierce
ATTORNEYS.

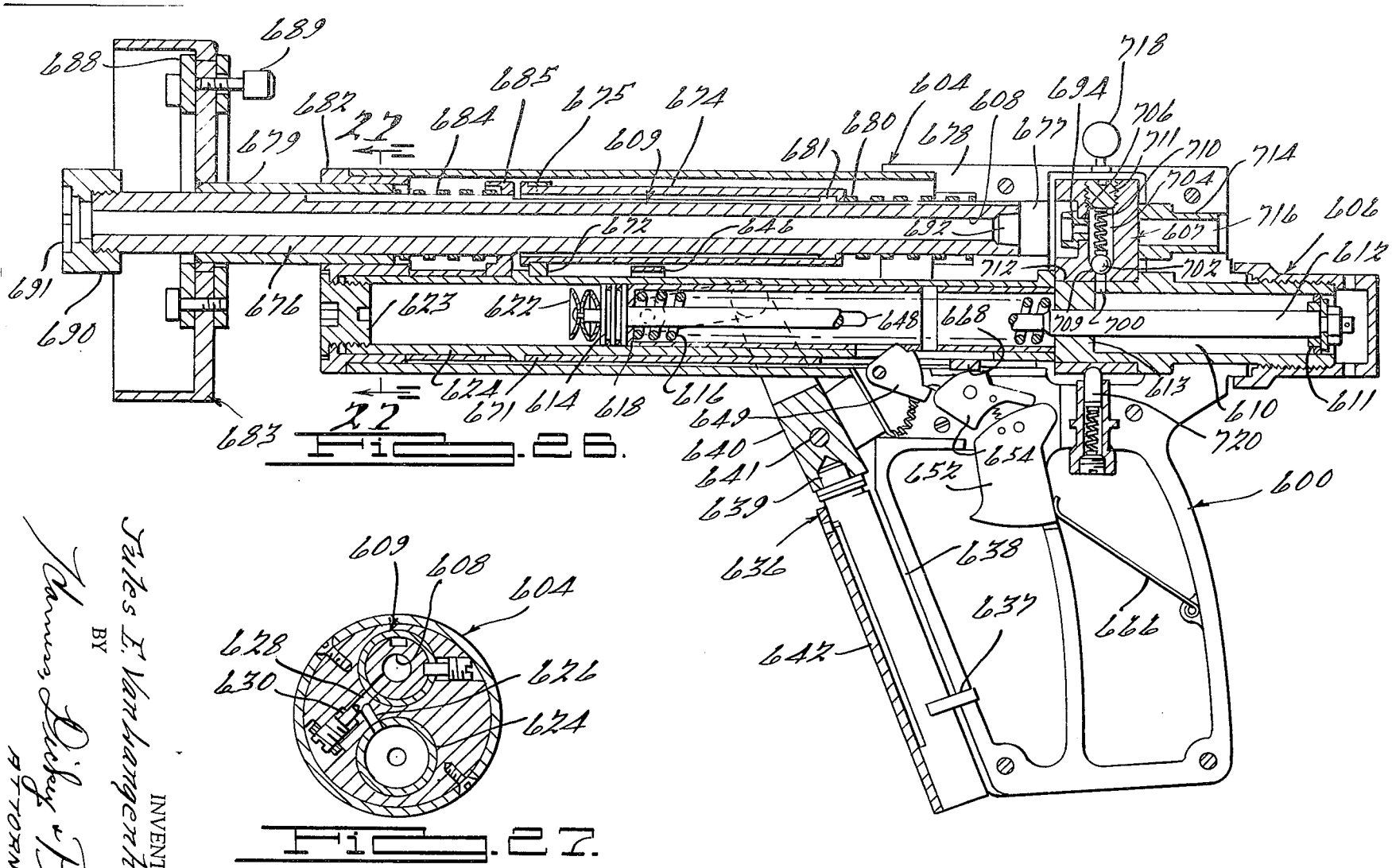
INVENTOR.
Jules E. Vanhangenhoven
BY
Kamm, Dickey & Pierce
ATTORNEYS.

INVENTOR.
Jules E. Van Langenhoven
BY
Harness, Dickey & Pierce
ATTORNEYS.

AIR OPERATED PROJECTILE FIRING APPARATUS

This application is a continuation-in-part of my prior copending application Ser. No. 189,621 filed Apr. 23, 1962 now abandoned which is based upon my Belgian Pat. No. 606,313, filed May 3, 1961, the benefit of the filing dates of whch are herein claimed. This invention relates to air operated projectile firing apparatus, and more particularly to new and improved means of imparting energy to a projectile for use therewith.

In general, the various inventive concepts disclosed herein are illustratively embodied in an ignitable propellant propulsion system, an air propulsion system, and a combination air propulsion system and ignitable propellant propulsion system.

The basic components of a device utilizing the ignitable propellant propulsion system comprise: barrel means for holding a projectile and an associated propellant, adapted and arranged to be ignited by surface contact with high temperature fluid in a firing position prior to ignition of the propellant and for guiding the projectile from the device after ignition of the propellant; a source of high temperature fluid having a temperature at which the propellant is ignitable by surface contact therewith; delivery means for delivering high temperature fluid from the source to the propellant in the firing position at a temperature at which the propellant is ignitable by surface contact therewith to discharge the projectile from the device; and blow back control means associated with the delivery means for preventing reverse flow of high temperature high pressure fluids after ignition of the propellant.

The basic components of a device utilizing the air propulsion system comprise: barrel means for supporting a projectile, adapted to be fired from the device by high pressure air, in a firing position prior to application of the high pressure air and for guiding the projectile from the device when fired; a source of high pressure air having a pressure at which the projectile is dischargeable from the barrel means; delivery means for delivering high pressure air from the source to the projectile at a pressure at which the projectile is discharged from the device; and velocity control means associated with the delivery means for controlling the velocity of the projectile.

The basic components of a device utilizing the air propulsion system and the ignitable propellant system in combination comprise: barrel means for holding a projectile and an associated propellant, adapted to be ignited by surface contact with high temperature air, in a firing position prior to ignition of the propellant in one mode of operation and for supporting a projectile, adapted to be fired from the device by high pressure air, in a firing position prior to application of the high pressure air to the projectile in another mode of operation and for guiding the projectile from the device in both modes of operation; a source of high temperature high pressure air having a temperature at which the propellant is ignitable by surface contact therewith in the one mode of operation and having a pressure at which the projectile is dischargeable from the barrel means in the other mode of operation; delivery means for delivering high temperature high pressure air from the source to the propellant at a temperature at which the propellant is ignitable by surface contact therewith to discharge the projectile from the device in the one mode of operation and to the projectile at a pressure at which the projectile is dischargeable from the device in the other mode of operation; and blow back control means associated with the delivery means for preventing reverse flow of high temperature high pressure fluids generated after ignition of the propellant in the one mode of operation.

The use of compressed air to propel a projectile has been used in a variety of applications. In air guns and the like, wherein the projectile is propelled by air, the propelling apparatus comprises an air compression chamber formed by a piston and cylinder assembly. Actuation of a trigger, or the like, releases the piston from a cocked position for rapid movement within the cylinder under the force of a compression spring or the like. Air in front of the rapidly moving piston is confined and compressed to increase the pressure thereof. The compression chamber is conventionally connected directly to the rear of a projectile, mounted in the breech block or gun barrel, by a passage or passages so that air under pressure will be continuously delivered behind the projectile during movement of the piston. The rapid movement of the piston causes an increase in pressure which is sufficient to move the projectile along the barrel as soon as the friction and inertia of the projectile are overcome and to force the projectile out o the gun barrel.

It has been previously proposed, in connection with an air propelled projectile, to provide a valve between the compression chamber and the projectile and to hold the valve in a closed position preventing flow of air from the compression chamber to the rear of the projectile until a predetermined high pressure condition is attained in the compression chamber whereupon the valves is thereafter moved to and held in an open position during discharge of the projectile by the compressed air.

Another type of known gun apparatus for propelling a projectile by high pressure air utilizes an accumulator chamber in addition to a compression chamber. In such apparatus, the piston and cylinder assembly is usually hand operated in some manner to compress quantities of air. A one-way check valve connects the compression chamber with the accumulator chamber so that high pressure air may be stored therein. A valve assembly is provided between the accumulator chamber and the breech block or barrel where the projectile is held. Upon actuation of a trigger device, the valve apparatus is momentarily opened to release a charge of high pressure air which is utilized to force the projectile out of the gun barrel.

The possibility of using high temperature compressed air to ignite a combustible material, including gun powder, has previously been suggested. Perhaps the best known example of the use of high temperature compressed air for ignition of a combustible material is in internal combustion engines in accordance with the well-known diesel engine principles. Attempts have been made to apply these principles to gun apparatus. For example, in order to increase the projectile velocity in air guns, it has been previously proposed to provide air gun apparatus with a liquid propellant which may be vaporized and ignited during an air compressing stroke of the gun apparatus. In such apparatus, a supply of liquid propellant is connected to the air compression chamber through suitable delivery means which may include a suitable valve mechanism. When the gun is actuated, a propellant charge is delivered by the valve mechanism to the compression chamber. As the piston in the compression chamber is rapidly moved by a spring means, or the like, to reduce the volume of the compression chamber and compress the air therein, the air temperature and pressure rise to a point at which the liquid propellant is vaporized and ignited. The projectile is commonly supported in direct communication with the compression chamber and is driven out of the barrel by the energy released when the liquid propellant is ignited. In apparatus of this type, the air compression chamber and the ignition chamber are one and the same. Consequently, any deleterious products of combustion are deposited in the air compression chamber, on the piston, and on the associated valves. Furthermore, the piston is movable rearwardly in response to increased pressures caused by the ignition of the propellant so that a non-rigid reaction well forms part of the ignition chamber.

The use of an ignition chamber ignitable by compression in a compression chamber and then delivered to a firing chamber to ignite a solid propellant, such as gun powder, associated with a projectile in the gun, has also been suggested. In one prior art disclosure, ignition of a charge of high test gasoline by compression of an air-gas mixture in a compression chamber directly connected to a projectile chamber has been suggested. It has been further suggested that a propellant associated with the projectile may be ignited by the ignited charge of gasoline.

Although the present invention may appear to have certain similarities to the aforediscussed apparatus, those skilled in the art to which this invention relates will readily appreciate that the distinctive characteristics and the improved results attained by the present invention are substantially different than the prior art.

It is an object of the present invention to provide new and improved projectile firing systems, devices, and associated apparatus.

Another object is to provide new and improved air gun type projectile firing devices operable to attain higher projectile velocities and increased range over previous apparatus.

Another object of the present invention is to provide an air gun in which air under pressure is delivered from a compression chamber to a projectile in a new and improved manner.

In connection with the use of air to propel a projectile it is an object of the present invention to provide means for controlling the application of compressed air from a compression chamber to a firing chamber in a manner in which projectile velocities may be varied. To this end, it is an object of the invention to provide adjustable valve means which may be utilized to prevent communication between a compression chamber and a firing chamber during the initial portion of a compression cycle in the compression chamber and which will open at a predetermined pressure within the compression chamber.

In connection with the use of air to ignite a propellant associated with a projectile in a firearm device or the like, it is an object of the present invention to provide valve means which, in an open condition, will permit high temperature air under pressure to pass from a compression chamber to a firing chamber and which will thereafter close as the pressure of air in the firing chamber approaches and becomes greater than the pressure of the air in the compression chamber. In this manner, a rigid reaction surface is provided between the compression chamber and the firing chamber so that maximum resistance to high pressure forces generated by ignition of the propellant in the firing chamber is attained. In addition the deleterious products of combustion are confined to the firing chamber.

A further object of the present invention is to provide new and improved compression means, obturation means, and loading means for multiple shot air gun apparatus utilizing hot air ignition means for igniting ignitable propellant to propel a projectile from the gun.

It is also an object to provide means by which projectile velocities attainable in a gun may be varied between low velocities and high velocities whereat the gun may be used for hunting or military purposes.

Another object is to provide a new and improved powder actuated tool utilizing hot air ignition of a propellant to drive a stud or the like.

Still a further object of the present invention is to provide improved means for igniting a propellant in association with a projectile.

Another object of the present invention is to provide new and improved projectile means for use with apparatus of the type described.

It is an additional object of the invention to provide new and improved propellants for use with apparatus of the type described and methods of making such propellants.

A further object is to provide new and improved propellant and projectile combinations.

The foregoing objects, and others, have been attained by the application of the inventive principles of the present invention to projectile firing systems, devices, and apparatus as hereinafter disclosed by reference to illustrative embodiments of the invention shown on the accompanying drawings wherein:

FIG. 5 is a schematic side elevational sectional view, with parts removed, of an alternative air gun structure embodying certain of the inventive principles and shown in a cocked operational position;

FIG. 6 is an enlarged sectional view of a portion of the apparatus of FIG. 5 shown in an uncocked operational position;

FIG. 26 is a side elevational view, in section, of a stud driving tool embodying certain of the inventive principles;

FIG. 27 is a sectional view of the apparatus shown in FIG. 26 taken along the line 27—27;

While certain features of the present invention are particularly well adapted for use in air guns and firearms having air ignition systems, it will be readily appreciated by those skilled in the art to which this invention relates that the inventive principles are also applicable to other devices such as powder actuated tools. The term "gun" and "firearm" as used in this specification and the claims are intended to be limited to a device such as a rifle or pistol or propellant actuated tool which is utilized to propel a projectile and to exclude dispensing devices such as lubricators or sprayers or the like which are sometimes also referred to as guns. Also, while certain forms of the ammunition are particularly advantageous in certain applications, the projectile design and the manner of attaching the propellant thereto may be varied as necessary and desirable depending upon such factors as the velocities required, breech pressures attained, the type of gun, and the projectile propellant characteristics.

Figure 1:
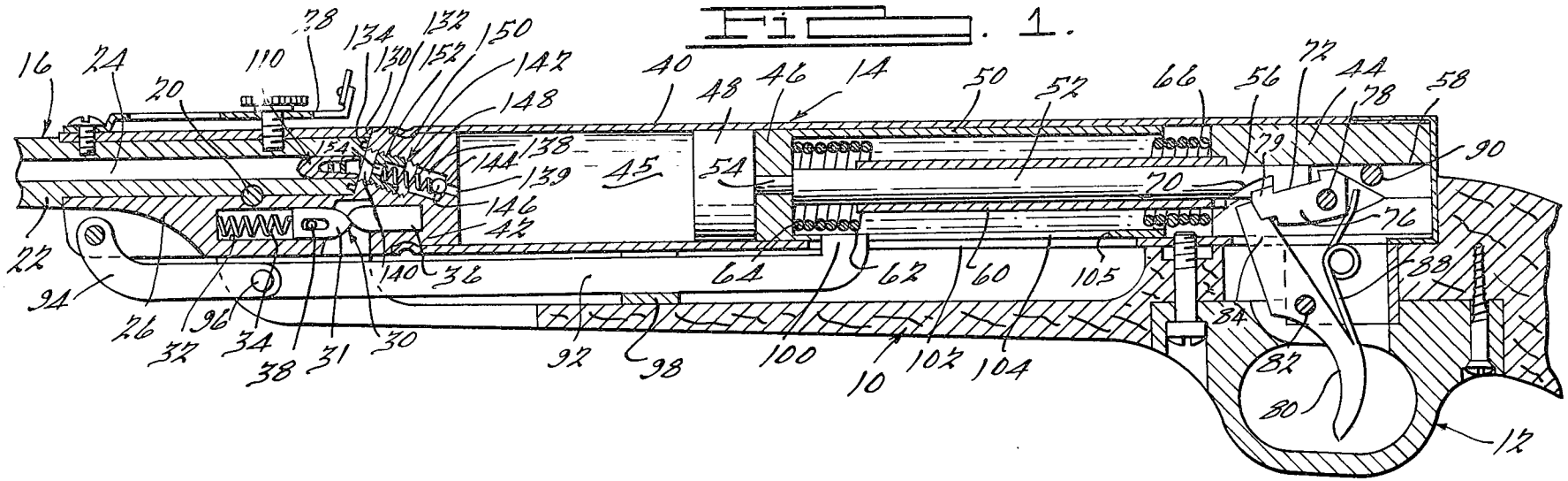
FIG. 1 is a partial side elevational view in section of an air gun embodying certain of the principles of the present invention.

Referring now to FIG. 1 of the drawings, an illustrative air gun embodying the principles of the invention is shown to comprise receiver means for supporting the operational mechanism in the form of a stock 10, a trigger assembly 12, a source of air in the form of air compression means including a piston and cylinder assembly 14 forming relatively movable air compression chamber means and piston means, and a barrel means assembly 16. The piston means and cylinder means are relatively movable with the cylinder means fixedly mounted in the stock 10 in a conventional manner and the barrel assembly 16 pivotally connected to the stock by a pin 20 for pivotal movement thereabout to provide loading means. The barrel assembly comprises a barrel 22 having a bore 24 and a connecting block 26 on which a sight mechanism 28 may be mounted. The connecting block 26 and barrel 22 are supported on the pin 20 within a cavity provided in the gun stock, and a locking mechanism 30 is provided to secure the assembly in the firing position shown in FIG. 1. The locking mechanism comprises a latch pin 21 which is slidably mounted in a bore 32 biased outwardly by a spring 34 for latching engagement with a fixed pin 36. As is conventional, a suitable release mechanism (not shown) is provided on the side of the stock and connected to a transversely extending pin 38 to release the latch pin when it is desired to pivot the barrel assembly about the pin 20.

The cylinder means comprises an elongated cylindrical shell 40 having a front end plug 42 and a rear end plug 44 fixedly secured therewithin. The piston means is reciprocably mounted within the cylinder to define a variable volume compression chamber 45 and comprises a plunger element 46 having a cup-shaped packing 48 mounted on the front end thereof. The plunger 46 has a rearwardly extending sleeve portion 50 within which an operating rod 52 extends. The front end 54 of the operating rod is connected to the plunger 46 and the rear end 56 is slidably received within a bore 58 provided in the rear end plug 44. A guide sleeve 60 is fixedly secured in the end plug 44 and extends longitudinally of the cylinder to provide a guide for the operating rod 52. Operating means in the form of a compression spring 62 is concentrically mounted about the operating rod 52 and the sleeve 60. One end 64 of the compression spring is seated on the plunger 46 and the other end 66 is seated on the end plug 44.

The rear end 56 of the operating rod is provided with notch 70 and a cam surface 72 for association with cocking means to cock the plunger by compression of the spring 62 to the position shown in FIG. 1. A trigger means is provided and comprises a sear 76 pivotally mounted on a pin 78 and a catch 79 adapted to be associated with the slot 70 of the operating rod. A trigger device 80 is pivotally mounted on a pin 82 and has a notched nose portion 84 engageable with the end of the sear 76. A spring element 88 biases the trigger to the latching position shown in FIG. 1. A stop 90 is provided to limit pivotal movement of the sear 76 when the trigger 80 is released.

The piston is movable to the cocked position by the cocking means levers 92, 94 which are pivoted at 96 and slidably supported within a suitable retainer 98 in the stock. The end 100 of the link 92 extends radially inwardly into the cylinder 40 through a slot 102. A similar slot 104 is provided in the sleeve portion 50 of the plunger so that the plunger and piston assembly are movable relative to the end 100 of the link. When the piston assembly is in its fully extended position (not shown) an abutment surface 105 at the end of slot 104 engages the lever end 100 so that axial displacement of the link 92 will cause corresponding axial displacement of the piston assembly. The link 92 is axially displaceable by pivotal movement of the barrel assembly about the pin 20 which causes a corresponding movement of the link 94 about the pin 96.

Figure 2:
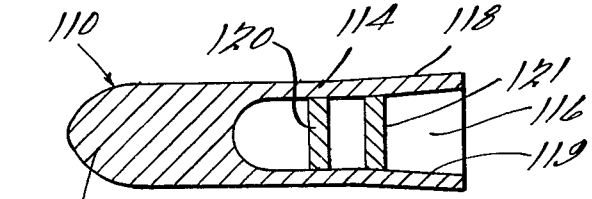
FIG. 2 is an enlarged sectional view of one form of a projectile suitable for use with the apparatus shown in FIG. 1.

A round of ammunition 110 adapted for use with the subject gun may be manually loaded into ammunition holding means at the rear end of the bore 24 when the barrel assembly is in the open position. The bore and the ammunition holding means together provide bore means by which the projectile is guided from the firearm. Referring to FIG. 2, the illustrative projectile comprises a lead mass, or the like, having a front end portion 112 and a rear end portion 114. In the illustrative embodiment, the projectile is provided with an inwardly extending bore 116. The rear end portion 114 is slightly outwardly flared as indicated at 118 for abutting obturating engagement with a similarly contoured portion in the barrel 22. The amount of taper is dependent upon the shot start force desired. With a propellant, the shot start force should be sufficient to hold the projectile in place during the compression stroke until the propellant is ignited. In an air propulsion system, the projectile could be modified to provide a lesser shot start force so that movement would begin at the beginning of the compression stroke. Bore 116 has a corresponding inwardly directed taper 119 as shown. The bore 116 provides a propellant storage and ignition chamber within which one or more propellant caps 120, 121 may be provided. In the embodiment shown, a pair of spaced propellant caps are illustrated. The propellant caps may comprise a nitrocellulose product which is ignitable under the effects of heat and pressure to create high energy. The caps have a disk like form which is readily insertable into the bore 116. The caps have a diameter slightly smaller then the open end of the bore 116 so that they may be pushed along the tapered surface 119 of the bore until they are firmly wedged in the ignition chamber provided thereby.

Although the caps may be made from any material which is adapted to be decomposed at a high temperature to produce an explosive or gas evolving action and which may be readily packaged, stored, and handled in a reliable manner, exceptional results are obtained from a porous nitrated cotton product. Nitrocellulose is particularly well suited for this use. A formula for and a method of manufacturing a suitable nitrated cotton product comprises the following steps and procudures: a commercially available cotton may be prepared for nitration by mixing the cotton in a solution of $H_2O$ and $Na_2CO_3$. The mixture is boiled for approximately one hour and the solution level is maintained by the addition of hot water as necessary. A suitable proportion is 50 grams of sterile bleached dry cotton; two liters $H_2O$, and 5 grams $Na_2CO_3$. After the cotton has been suitably prepared, it should be rinsed thoroughly. Water at approximately 59°F may be added to the bottom of the tank in which the cotton has been boiled. Cotton should be held under the water during rinsing and the rinsing operation should continue until pH of 7 is attained. If necessary, a second rinse may be utilized to insure that the cotton is thoroughly cleaned. Then the cotton should be subjected to a centrifuging action or the like, to remove most of the water. Then the cotton should be dried, for example, in an oven at approximately 140°F.

After the cotton has been suitably prepared, it is nitrated by mixing in a solution of nitric acid, sulfuric acid, and potassium nitrate. The nitric acid is first added to the sulfuric acid and mixed at approximately 41°F and care should be taken to keep the temperature below approximately 59°F while mixing. Then the potassium nitrate is added and the temperature is maintained below 59°F. A suitable formula is 148 grams of nitric acid, 1.48 density, 452 grams sulfuric acid, 1.842 density, and 69 grams potassium nitrate.

After the nitration solution has been prepared, the dry cotton is added to and mixed in the solution. Again the solution temperature should be maintained at approximately 59°F and the cotton temperature should be at about 68°–77°F. In a nitration formula as described above, approximately 22.3 grams of the dry cotton is added to the 669 grams of the nitrating solution. The cotton should be soaked in the nitrating solution for approximately 10 hours with the temperature being maintained below approximately 77°F. After the cotton has been soaked in the nitrating solution, the cotton is removed from the solution and rinsed in pure water until a pH of 7 is again obtained. Then the nitrated cotton may be subjected to the action of a centrifuge and dried at 77°F until a moisture content of approximately 7 per cent is obtained.

With the aforedescribed nitrated cotton product, the caps are very porous, easily ignited, completely burned upon ignition, and no undesirable residues are left in the barrel or the associated parts of the gun. While in most instances, the propellant may be manufactured, stored, and used in a solid stable form, it may be desirable, in some cases, to cover the propellant disks with a thin plastic like film over the entire periphery. The plastic like film may take various forms and, for example, be provided by the nitrating solution itself.

Referring again to FIG. 1, the end plug 42 is provided with an abutment surface 130 at its forward end which is adapted to cooperate with a similar abutment surface 132 provided on the end of the barrel assembly whereby the barrel assembly is connected to the air source by relatively movable breech means. While the surfaces 130, 132 are shown to be inclined in the illustrative embodiment, the surfaces may also be at right angles to the longitudinal axis of the gun barrel as is conventional. Obturation means in the form of a suitable packing 134 of leather, rubber, or the like is provided between the surfaces 130 and 132 to obtain a seal therebetween in the locked position of the barrel assembly relative to the gun. Air delivery means comprising passage means 138 are provided in the end plug and communicate at one end with the bore 24 and the other end with the compression chamber. In the illustrative embodiment of FIG. 1, the passage means are inclined and extend from an opening 139, centrally located relative to the compression chamber at a right angle to the surface 130. The passage means terminate in an opening in alignment with the bore 24. The forward end of the passage means 138 provides a firing or ignition chamber 140 in association with the adjacent portions of the barrel and projectile.

Figure 3:
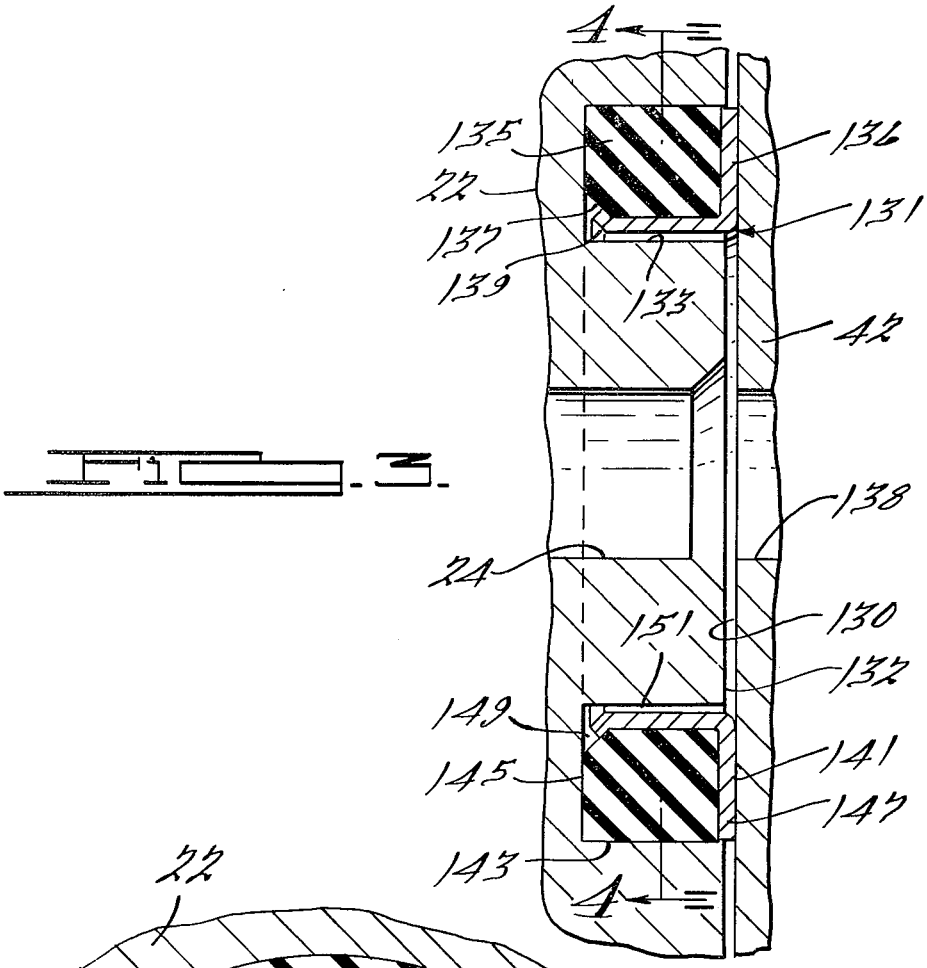
FIG. 3 is an enlarged view, in section, of alternative obturating means which may be used with the apparatus shown in FIG. 1.
Figure 4:
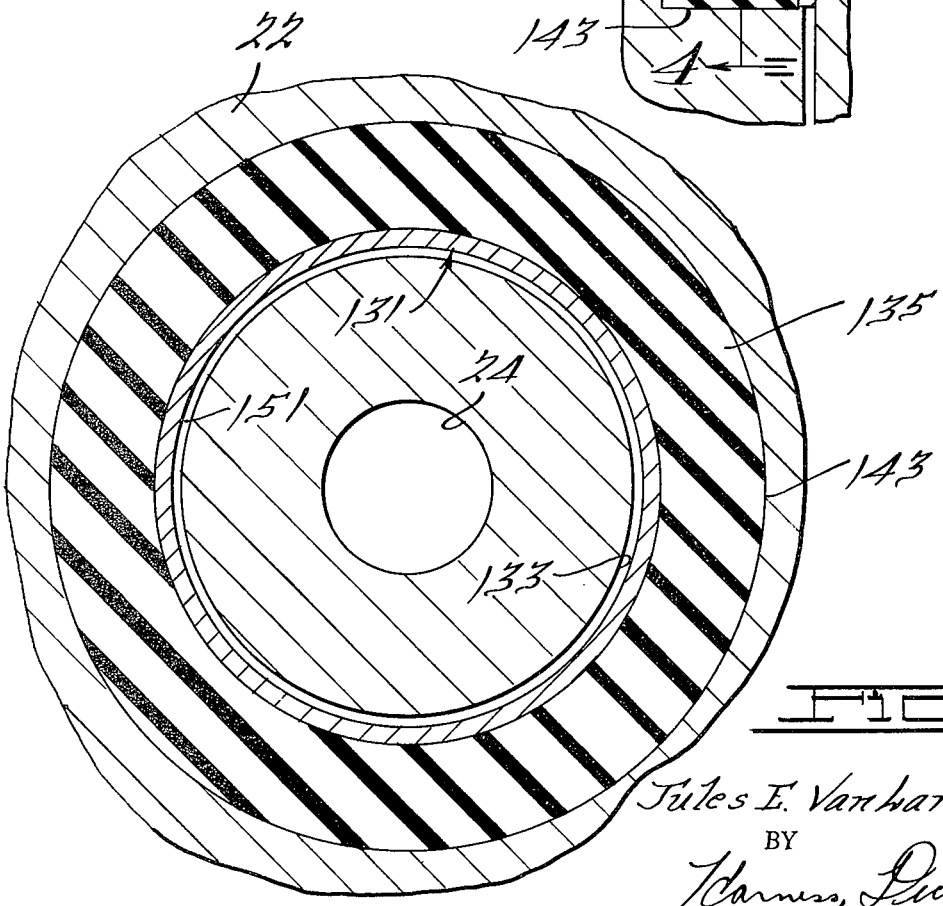
FIG. 4 is an end view of the apparatus shown in FIG. 3.

A presently preferred form of obturation means for this type of gun is shown, in FIGS. 3 and 4, to comprise an annular ring assembly 131 adapted to be mounted in a groove 133 surrounding the barrel bore 24. The ring assembly is formed from a ring of plastic material 135, such as Teflon, and a protection rim 136 of metallic material, such as brass or the like. In the presently preferred embodiment, the protecting rim is L-shaped in cross-section and provides particularly good results because of its shape as hereinafter explained, but it is contemplated that the other cross-sectional shapes such as, for example, U-shaped might be utilized. The bottom inner edge 137 of the plastic ring is chamfered and the bottom inner edge 139 of the protecting rim is crimped into engagement therewith to form the assembly. In the closed position of the gun, the end plug 42 abuts the metallic protecting rim as shown at 141, and the plastic sealing ring is resiliently compressed in the groove and forced into engagement with the walls of the groove at 143, 145. The metallic rim protects the plastic ring from abrasion and from adverse effects of the high temperature gases generated during firing of the gun. The protective rim is preferably made from a material which has a degree of resiliency or flexibility sufficient to enable the outer sealing wall 147 to resiliently deflect when the breech is closed. Since the protective rim is resiliently supported by the plastic sealing ring, the whole rim is tiltable and movable to insure good sealing engagement with the surface 130. The material should also be of good heat conductivity to minimize the possibility of heat damage to the plastic ring caused by the high temperature gases. The chamfered inner edges of the assembly provide a gas pocket 149 to which the high pressure gases may flow through space 151 to be effective to exert forces on the ring assembly toward the end plug 42 and the area of contact 143 so as to increase the seal. It will be apparent that the ring assembly is sufficiently oversize relative to the depth groove so as to cause a tight seal to be formed between the bottom and side surfaces 143, 145 of the plastic ring and the groove due to the compressive forces exerted thereon when the barrel assembly is locked in the closed position.

Referring again to FIG. 1, a single flow control means is provided in the passage means 138. In the illustrative embodiment of the invention, the flow control means is in the form of a valve assembly 142 which is adapted to provide means for closing the compression chamber to the firing chamber during a portion of the compression stroke of the piston, means for adjustably variable opening the compression chamber to the firing chamber when a preselected pressure of the air being compressed is attained, and means for closing the firing chamber to the compression chamber after air at a temperature sufficient to cause ignition of the propellant has been delivered to the firing chamber from the compression chamber. Thus, in the illustrative embodiment, the various functions are combined in a single valve assembly to control the delivery of compressed air from the compression chamber to the firing chamber, and to additionally control the reverse flow of compressed air or combustion gases from the firing chamber to the compression chamber. The valve assembly includes a valve seat 144 opening toward the firing chamber and a ball valve 146, or the like, which is adapted to be seated thereon. The ball 146 is abuttingly engaged by one end of a spring 148 which is seated at the other end on a plug 150. The spring is held in compession by the plug 150 which is threadably mounted in a tapped portion 152 of the passage 138. The plug is provided with passage means in the form of a slot 154 which is adapted to receive a screwdriver or other implement to permit adjustment of the axial position of the plug within the passage to vary the force exerted by the compression spring. It will be understood, that the various functions and the means for attaining those functions, may be separately attained and utilized or employed in various other combinations and arrangements.

In operation of the aforedescribed gun apparatus, with the piston assembly cocked as shown in FIG. 1 and a projectile held in the rear end of the barrel, the gun is ready for firing. A firing cycle is initiated when the trigger 80 is pulled rearwardly about the pivot 82 to release the sear 76 and unlatch the operating rod 52 of the plunger. The compression spring 62 drives the piston assembly fowardly within the cylinder at a rapid rate. Air trapped in the compression chamber 45 is compressed as the volume of the compression chamber is reduced. In the illustrative embodiment, the compression chamber may be completely closed during the initial portion of the air compression and held in a completely closed condition until the ball valve 146 is suddenly lifted from sealing engagement with the seat 144 against the bias of the compression spring 148. The adjustable plug 150 is previously located at a depth within the passage 138 which compresses the spring to a point whereat the ball will be forced off the seat at a predetermined pressure.

When the pressure of the air in the compression chamber has been increased to the predetermined pressure, the ball valve is suddenly and rapidly moved off the valve seat. The high pressure air in the compression chamber 45 rushes through the passage 138 and into the firing chamber 140 in what is believed to be a kind of a shock wave. When a projectile 110 without any propellant is being used, the shock wave of air drives the projectile through the bore 24 and out of the barrel. The ball valve remains open until the pressure differential between the firing chamber and the compression chamber reaches a point whereat the air in the compression chamber no longer adds any force to the projectile driving action of the compressed air in the firing chamber. At this time the ball valve closes and the firing chamber and the compression chamber are again completely sealed from one another.

In conventional guns wherein the air compression chamber communicates directly with the barrel through an open channel or passage, air compressed by movement of a piston in a compression flows directly against the rear of the projectile and urges it out of the barrel when the pressure of the air reaches a value capable of overcoming the inertia and friction of the projectile. In some guns, the total stroke of the piston is used to accelerate the projectile and the projectile starts to move at the beginning of the stroke of the piston. In other guns, the inertia and friction of the projectile is not overcome until sometime after the beginning of the piston stroke. In any event, the pressure of the air in the compression chamber usually reaches the aforementioned value when the piston has traveled a relatively short distance which is only a portion of its total travel within the air compression chamber. Furthermore, since the length of travel of the projectile is greater than the length of travel of the piston along the barrel, the full stroke of the piston is completed before the projectile leaves the barrel.

Thus, one aspect of the present invention relates to flow control means in the form of, for example, a gauged check valve provided between the compression chamber and the gun barrel to prevent the compressed air in the compression chamber from entering the gun barrel and acting on the projectile until a predetermined air pressure has been reached. By delaying the release of air in the compression chamber until the piston has traveled through a larger portion of its stroke, whereat a much higher air pressure is developed but the length of time of application is reduced, the velocity of an air propelled projectile can thus be controlled by varying the force necessary to open the check valve. Maximum velocities will be attained when the valve opens at low pressures at the beginning of the piston stroke.

Another aspect of the invention relates to hot air ignition of a propellant associated with a projectile. The temperature attained by the compressed air in an air gun, which is directly related to the pressure attained and heat loss sustained, is sufficient to ignite a charge suitably associated with a projectile in the gun. In one form, the charge may be fitted inside a charge cavity provided at the rear of the projectile and in another form, the charge may be mounted on the rear of the projectile. The charge preferably takes the form of one or more caps formed from a substance which is adapted to decompose or burn under the combined effect of temperature and pressure. The temperature and pressure of air in the compression chamber is sufficient to decompose and burn the material. Particularly advantageous results may be obtained by the use of a porous nitrocellulose material or a similar explosive manufactured in pellet or cap form is hereinbefore described.

Whether or not a valve is used to close the compression chamber to the firing chamber, in which the propellant is ignited, during a portion of the compression stroke, it is generally necessary and desirable to provide valve means for closing the firing chamber to the compression chamber after the air has reached a temperature sufficient for causing ignition of the propellant and before or at the time of ignition of the propellant. Thus, the valve is designed so that the propelling thrust attained by the use of the nitrocellulose will be confined to the firing chamber and will have no effect in the compression chamber. The valve closes when the pressure in the firing chamber exceeds the pressure in the compression chamber and, under action of the thrust produced by the ignition of the nitrocellulose, provides a rigid reaction wall between the compression chamber and the firing chamber.

It is possible with the apparatus of the present invention to utilize an ignitable propellant by which a level of energy sufficient for relatively high velocity propulsion may be obtained. The propellant may be associated with and carried by the projectile prior to loading of the gun. As previously described, solid nitrocellulose caps 120, 121 may be mounted in a cavity 116 provided in the end of the projectile. The caps are ignitable when subjected to high temperatures, and when ignited provide a high energy source for projectile propulsion. In general, while certain propellants might be ignitable at lower temperatures, it is desirable to provide compression means by which temperatures in the range of 400°F to 700°F are attainable. In general, the pressure and temperature for causing ignition of the propellant caps is obtained as a result of the adiabatic compression of the air in the compression chamber. It will be readily appreciated that the temperature desired may be obtained by suitable adjustment of the compression variables until the desired temperature level for ignition in a particular gun design and for a particular propellant is attained. It has been found that the temperature of the air delivered to the firing chamber is primarily a function of the size of the compression chamber and the rate of movement of the compression piston. The time or portion of the piston stroke at which the passage connecting the compression chamber to the firing chamber is opened appears to be of no particular consequence. Thus, whether the passage is open at the beginning of the stroke or near the end of the stroke, the temperature of the air in the firing chamber will be about the same. Therefore, in many applications, the spring 148 may be adjusted to the condition whereat the valve is normally open or opens at the beginning of the compression stroke. In fact, as discussed in detail hereinafter, the valve function of closing the compression chamber to the firing chamber during compression may be dispensed with completely.

When the ball valve 144 is open, the air flows through the passage 138 and into the firing chambers 140 and 116. The projectile is held in position by frictional engagement between the enlarged tapered portion 118 and the barrel. The propellant caps are ignited by surface content with the high temperature air in the firing chamber and a high level energy source is thereby provided for propulsion. The projectile is driven from the barrel by compression of the enlarged flared portion 118 as the shot start force is reached. The ball valve is mounted in a way which insures that the passage means connecting the compression chamber and the firing chamber will be closed as soon as the pressure differential existing between the firing chamber and the compression chamber is reversed so that the energy released by ignition of the propellant and the products of combustion are confined to the firing chamber. It has been found that there is an ignition time delay such that the valve closes at the end of the compression stroke before ignition of the propellant, the pressure differential being attained by leakage in the compression cylinder past the piston. Consequently, the valve holds the high pressure air in the firing chamber while the propellant is heated to the ignition temperature and the valve is closed at the time of ignition so that the high energy developed by the ignition of the propellant is not dissipated by reverse fluid flow into the compression chamber, but is confined to propulsion effects on the projectile within the firing chamber. The ball valve provides fixed reaction surface when it is seated on the valve seat.

Accordingly, it may be seen that with the subject valve means and projectile and propellant combination, an air gun may be readily converted from low velocity applications to hunting and military uses. If the gun is to be used to fire propellantless projectiles at relatively low velocities, the valve means may be adjusted to open at relatively high pressures which will impart relatively low velocities to the projectile. If the gun is to be used for other purposes requiring higher velocities, the valve means may be adjusted to open at low air pressures to produce higher projectile velocities with an air propelled projectile. If the velocities attainable by the use of high pressure air alone are not sufficient for the purposes intended, the projectile may be loaded with a propellant in the form of the nitrocellulose caps disclosed. The addition of the nitrocellulose caps and the utilization of the air compression means to attain air compression producing the required temperature and pressure for ignition of the propellant converts the gun to a maximum velocity weapon.

A comparison of the present structure with prior art devices which utilize a liquid propellant in an air gun will illustrate many of the advantages of the disclosed apparatus. In the present gun, no liquid propellant storage means or complicated valve and injection system is required. In this application and claims, the term "chargeless fluid" refers to a fluid such as air, for example, to which no ignitable fuel or powder or propellant or the like has been added to form an ignitable or combustible or explosive mixture adapted to be ignited before the fluid contacts and ignites ammunition propellant. Furthermore, the firing chamber and the compression chamber are separated from one another so that combustion residues will not corrode the piston element and the cylinder element. In addition, a firing chamber having fixed reaction walls is provided for ignition of the propellant of the present invention. In prior art devices which utilize a combined compression chamber and ignition chamber, high pressures created in the chamber by the ignition of the liquid propellant are dissipated in part by the movable rear wall formed by the piston. In the present apparatus, the energy created in the firing chamber is effective only to move the projectile and nothing else. The propellant of the present invention is easily stored and is not subject to evaporation, leakage or loss due to breakage of containers.

Furthermore, in the use of the present invention without the propellant, many advantages are attained over prior art air guns. It should be apparent that the provision of an adjustable valve means between a compression chamber and a projectile firing chamber enables the use of a wide range of operating conditions. The valve means serves the dual function of controlling the pressure of the air applied to the projectile and, in its closed position, of providing a fixed reaction surface. The valve mechanism directly connects the compression chamber and the firing chamber without the requirement of any accumulator chamber. Accordingly, prior devices wherein a valve means connected an accumulator chamber with a firing chamber were not intended to and did not produce equivalent results.

Referring now in detail to FIGS. 5–18, alternative embodiments of certain of the inventive features are shown in connection with a repeating type air operated rifle comprising, in general, a body portion or receiver 221 that supports a barrel means assembly 222. The barrel assembly includes a barrel 223 having a bore 224 for guiding a projectile. A source of high temperature fluid is provided by air compression means 225 positioned within the receiver 221 at the rear of the barrel 223. A cocking means 226 is provided for cocking the air compression unit. A trigger means 227, positioned toward the rear of the receiver, is actuable to operate the compression unit which results in a projectile being propelled from the barrel 223. Breech means connect the air compression unit to the barrel means and comprise ammunition transfer means in the form of a revolving cylinder assembly 228 interposed between the air compression unit and the barrel for delivering rounds of ammunition from a loading position adjacent suitable magazine means (not shown) in rapid succession to a firing position adjacent the barrel 223. Ammunition support means and firing chamber defining means are integrally formed in the ammunition transfer means for holding the ammunition in the firing position in alignment with the barrel means. The breech means further comprises obturation means provided to close the firing chamber in the firing position. An ejection means 229 is positioned adjacent the revolving cylinder assembly to clear the ammunition chambers of the cylinder assembly at certain times, as will be hereinafter described, during operation of the gun.

Figure 7:
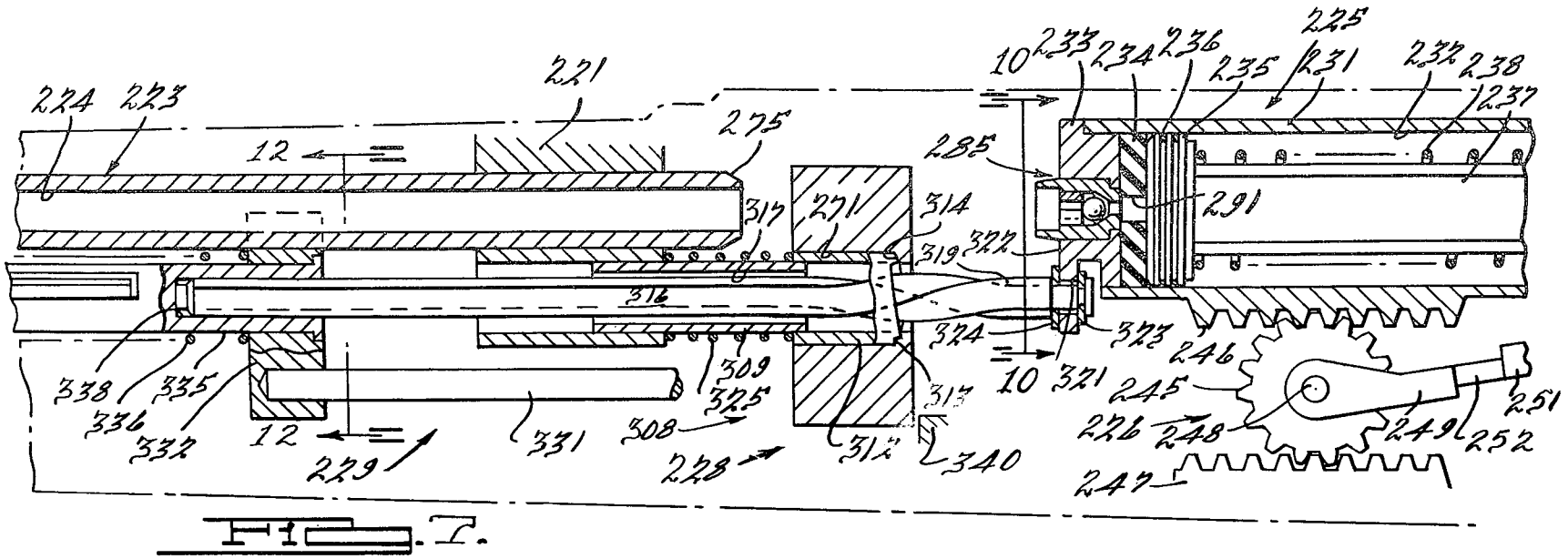
FIG. 7 is an enlarged sectional view of a portion of the apparatus of FIG. 5 shown in an intermediate operational position during a cocking operation.
Figure 8:
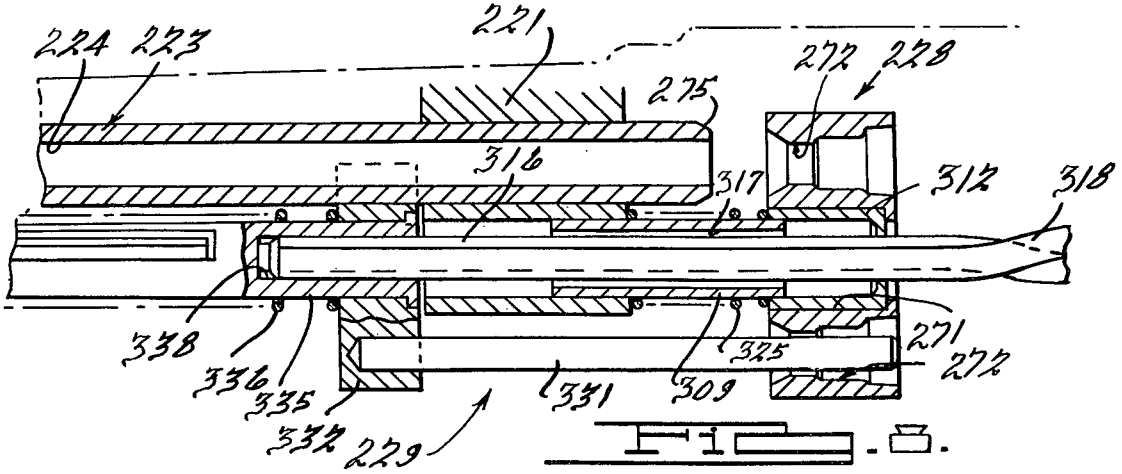
FIG. 8 is an enlarged sectional view of a portion of the apparatus shown in FIG. 7 in another intermediate operational position during a cocking operation.

Referring now to FIGS. 5 through 7, the air compression means 225 comprises relatively movable compression chamber means and volume varying means with the chamber means being formed by a movably mounted cylinder means and volume varying means being formed by movably mounted piston means. The cylinder means is movable between an ammunition loading position (FIG. 7) and an ammunition firing position (FIG. 5), and the piston means is movable between a cocked position (FIG. 5) ready for firing of the gun and an uncocked position (FIG. 6). The cylinder means and the piston means are movable relative to one another at certain times, with first one and then the other being fixedly retained, and are movable together at other times during operation of the gun.

Air cylinder 231 has an axially extending bore 232 formed therein. The air cylinder is supported for reciprocation relative to the receiver for a reason which will become apparent as this description proceeds. The end of the air cylinder 231 adjacent to the barrel 223 is closed by a head 233 which may be affixed in any suitable manner to the air cylinder. A resilient disk 234 is positioned adjacent the head 233 to provide a seal between the air cylinder and head and a cushion for a piston head, as will become more apparent as this description proceeds. A conventional type air compression piston 235 having a plurality of grooves that may receive sealing rings 236, forming a labyrinth type seal, is supported for reciprocation within the bore 232. In the preferred embodiment, the seal is formed by the grooves themselves without rings. The piston is integrally connected to an elongated piston rod 237.

Actuating means in the form of a coil spring 238 engages the piston 235 at one of its ends and a fixed abutment 239 at its other end. The coil spring 238 normally urges the piston toward the cylinder head. Trigger means are provided to release the piston in the cocked position and includes a sear 241 pivotally supported on a pivot pin 242. The sear 241 has a groove 243 that is adapted to receive a protuberance 244 formed at the inner end of the piston rod 237, when the piston is in the cocked position (FIG. 5).

The cocking mechanism 226 includes a pinion gear 245 that engages a rack 246 formed integrally on the underside of the air cylinder 231 and a rack 247 that is fixed in the receiver 221 below the cylinder 231. The pinion gear 245 is journaled upon a pin 248 carried at the forward end of a lever 249 which may be a one-piece member or connected to intermediate links 251, 252. The rear end of the lever is pivotally connected, as by a pin 253, (FIG. 5), to a forwardly extending arm 254 of a cocking lever assembly pivoted at 255 and having a rearwardly extending portion 256 in which a trigger finger hole 257 and a cocking handle 258 are provided.

The trigger mechanism includes trigger 259 pivotally supported upon a pin 260 and extending into the trigger finger hole 257. The forward end of the trigger has a depending projection 261 adapted to contact a manually operable safety in the form of a shaft 262 having a segmented portion 263. An upstanding projection 264 of the trigger 259 contacts a depending arm 265 of a lever 266 pivotally supported upon a pivot pin 267. A detent 268 is adapted to be received in a notch 269 formed in the sear 241.

Referring now additionally to FIGS. 8, 9, 13, and 14, the revolving cylinder assembly 228 is a unitary piece formed with a centrally located generally cylindrical bore 271 around which are positioned a plurality of equally spaced ammunition chambers, indicated generally by the reference numeral 272. In the illustrated embodiment, three chambers 272 are provided. It is to be understood that any desired number of cavities may be provided.

Each of the ammunition chambers are provided with barrel obturation means comprising a chamfered section 273, formed at the end of the cylinder 228 adjacent to the barrel 223, which is adapted to form a lead collecting groove 274 and receive a beveled end 275 of the barrel when the gun is in the firing position. A first cylindrical bore 276, corresponding to the barrel bore 224, is provided adjacent the chamfered section 273 and the opposite end of the bore 276 terminates next to a larger diameter bore 277 joined by a beveled section 278 which form projectile holding means as hereinafter described in detail. Firing chamber obturation means are provided and comprise a tapering obturation chamber 279 extending to the rear face of the revolving cylinder 228, adjacent the air compression unit, and terminating at its ends in a round 281 and a round 282.

The firing chamber obutration means further comprises obturator plug means 285 (FIG. 9) interposed between the air compression means and the ammunition chambers 272. The obturator plug means comprises a generally cylindrically shaped housing 286 press fitted within a bore 287 formed in the cylinder head 233. The end of the obturator housing adjacent the rotating cylinder assembly 228 is formed with a tapered portion 288 that is complementary to the tapering bore 279 in the revolving cylinder 228. An air passage 289 is formed in the obturator housing and connects to a larger passage 291 formed in resilient disk 234 to provide air passage delivery means by which high temperature air is delivered from the compression chamber. Obturator air passage 289 merges into a chamfered section 292 forming a seat for flow control means in the form of a ball check valve 293. In the presently preferred form of the invention, the check valve 293 is floatingly supported for movement within a bore 294 extending from the chamfered section 292 through the obturator housing 286. A coiled retaining member 295 (FIG. 10) is positioned at the outer end of the bore 294 to floatingly retain the ball check valve 293 within the bore. An enlarged chamber 296 is formed at the mouth of the bore 294 adjacent the retaining member 295.

Figure 9:
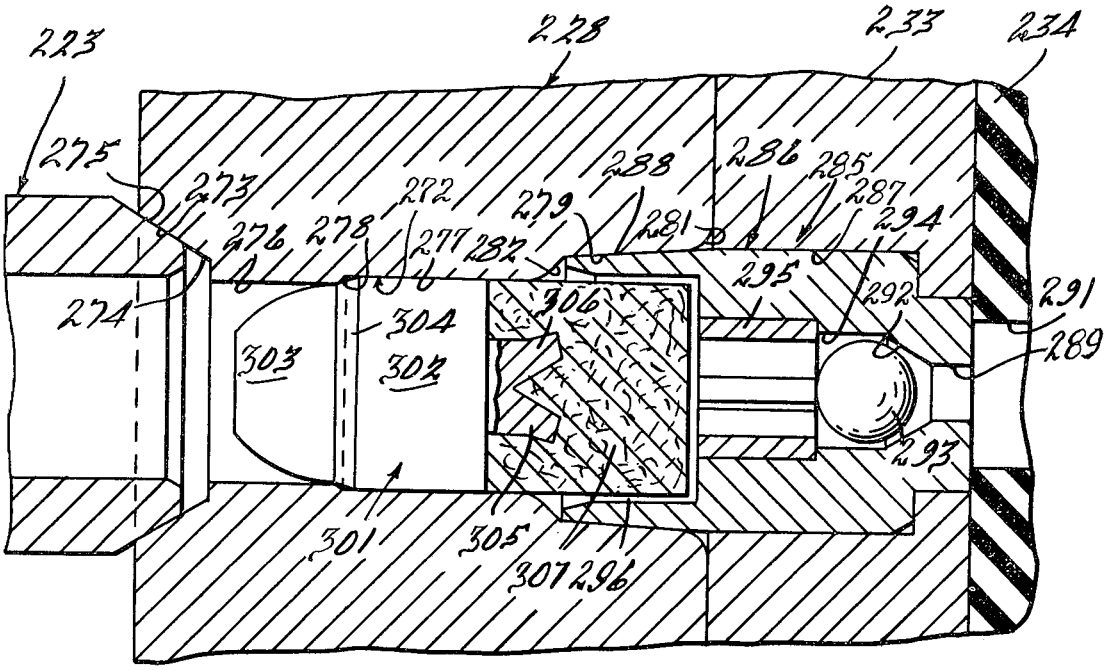
FIG. 9 is an enlarged sectional view of a portion of the apparatus in FIG. 5 shown loaded with a round of ammunition of presently preferred form and in a firing position.
Figure 10:
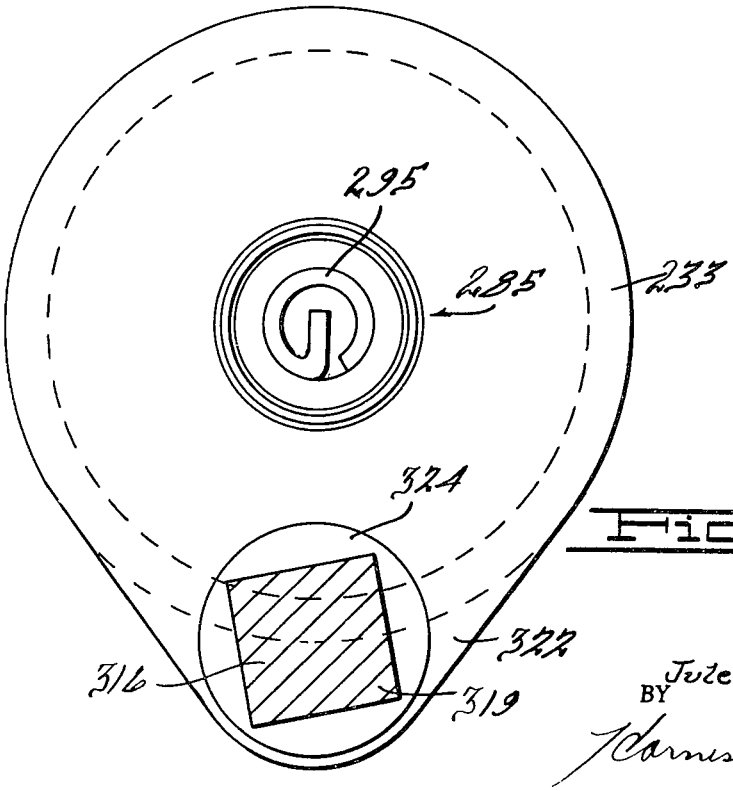
FIG. 10 is an enlarged cross-sectional view taken along the line 10—10 in FIG. 7.
Figure 11:
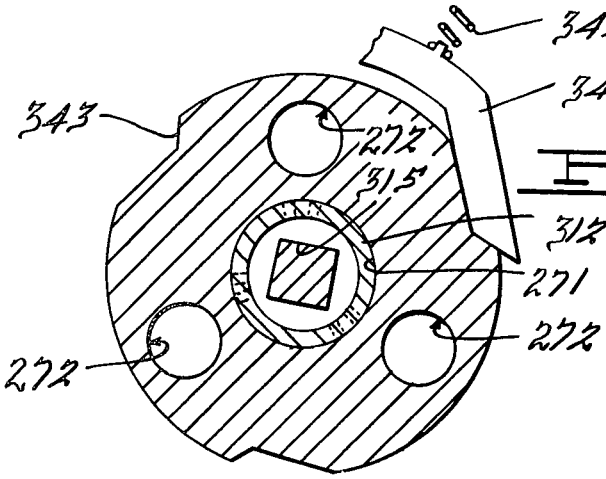
FIG. 11 is a cross-sectional view taken along the line 11—11 in FIG. 6.

Caseless rounds of ammunition, indicated generally by the reference numeral 301, and shown in detail in FIG. 9, are adapted to be positioned within the ammunition chambers 272 of the revolving cylinder 228. In the presently preferred form of the invention, each round 301 comprises a metallic (e.g. lead) slug having a generally cylindrical section 302, complementary in diameter to the bore 277, and an end section 303 adapted to extend into the bore 276. A beveled section 304, connecting sections 302 and 303, is adapted to abuttingly engage the beveled section 278 of the projectile cavity 272 formed between the bore 276 and 277 to axially position the round within the revolving cylinder 228. The diameter of the cylindrical portion 302 is sufficiently larger than the diameter of the bore 276 so as to form a seal between the shoulders 278 and 304 and to hold the projectile in place in the ammunition chamber until the propellant has been ignited and sufficient force is obtained to compress the lead projectile and force it past the shoulder 278 and into the bore 276 and down the barrel bore 224. It is desirable to have an arrangement providing a shot start force greater than the force obtained by compression of the air alone so that the projectile will not start to move until after the propellant has been ignited. If a propellantless air driven round of ammunition is to be used, the amount of frictional retention between the projectile and the ammunition chamber is reduced greatly so that the ammunition is merely supported in the ammunition chamber and is driven into bores 224, 276 as soon as or shortly after the compression stroke begins. In this manner, the gun may be used as a high velocity weapon with a round of ammunition having propellant associated therewith and a high shot start force, and may be used as a low velocity air gun with a modified round of propellantless ammunition having a low shot start force.

Propellant attaching means are provided in the form of a stub shaft portion 305, integrally connected to the cylindrical section 302, and terminating in a radially displaced upset portion 306. In the presently preferred embodiment of the invention, a disk of solid propellant 307, corresponding in diameter to a cylindrical section 302, is fixed to the stub shaft portion and held in place by upset portion 306. While the presently preferred manner of associating the propellant with the projectile provides particularly advantageous results, it is contemplated that the propellant might be otherwise attached such as by directly bonding the propellant to the rear of the projectile without utilizing the post 305. In the preferred embodiment, the length of the propellant portion is approximately equal to the length of the main portion of the projectile. The diameter and depth of the chamber 296 are chosen so as to provide a minimum air gap and a minimum air volume. In the firing position, the high temperature ignition air will be confined in an ignition chamber defined by the ammunition, the walls of the ammunition chamber, the walls of the chamber 296, and the air passage means extending from the valve seat 292. It will be apparent that the "ignition" chamber is in effect also at least part of the "firing" chamber. The propellant 307 may be of any type, which is sufficiently porous to be ignitable by surface contact with high temperature air such as compressed within the firing chamber 296 by the air compression unit 225, as will become more apparent as this description proceeds. The propellant 307 may be made up of a homogeneous mass of propellant material or of several layers of different propellant material each of which may be molded, extruded, or otherwise mounted on the projectile. The layers may have successively higher ignition points progressing toward the projectile to provide a greater thrust if so desired or may be otherwise varied and modified to attain particular ignition and firing characteristics.

In the presently preferred form of the invention, the propellant is manufactured into a doughy mass suitable for formation in pellet or cap form separately from the projectile or directly on the projectile. This type of ammunition is caseless and the entire round is fired from the gun without residue.

The propellant made in accordance with the practice of the present invention is formed into porous pellets containing as essential elements therein an ignitable explosive material and a cellulose binder material.

The explosive constituent may consist of any of the well-known single-base, double-base, or triple-base explosive materials consisting principally of commercially available nitrocellulose having a degree of nitration usually from about 13.2% to 13.5% N and which is also known as guncotton or smokeless powder. The nitrocellulose explosive constituent can be employed in any of the commercially available forms such as, for example, in the form of fibers (e.g. water system) or solvent-softened grains (e.g. solvent system), to provide the desired burning characteristics and porosity of the resultant propellant pellet. In forming nitrocellulose grains, any one of a variety of suitable solvents can be satisfactorily employed which are miscible or emulsifiable with water in order to assure uniform distribution thereof and wetting of the nitrocellulose fibers. Solvents which are particularly suitable for this purpose include acetone, methyl ethyl ketone, dimetyl ether, diethylene glycol, ethyl glycol, or the like, of which acetone is the preferred solvent. The solvent can be employed either individually or in mixtures thereof in order to achieve the desired swelling of the nitrocellulose explosive constituent. So-called double-base explosives can also be satisfactorily employed for the purposes of the present invention by adding nitroglycerine to the nitrocellulose in amounts conventionally ranging from about 5% up to about 40%. Similarly, triple-base explosives can be made by additionally adding nitroguanidine to the nitrocellulose containing the nitroglycerine.

In addition to the explosive constituent, the mixture employed for forming the propellant also includes a water-soluble or water-solvent soluble organic binding agent which is effective to retain the water or water-solvent employed during formation of a pasty or dough-like mixture and during the shaping, casting, or extrusion thereof into wet slugs or pellets of the desired shape and size. Subsequently, the water or water-solvent is removed to provide the desired porosity. Binding agents which have been found particularly suitable for this purpose include cellulose derivatives such as methylcellulose, hydroxyethyl cellulose, carboxymethyl cellulose, carboxyethyl cellulose, starch, arabic gum, or the like. The quantity of the cellulose binder material employed is dependent on the quantity of water used in the mixture and is controlled in an amount to prevent excesive exudation of the water during the forming or shaping of the wet mixture into slugs. In most instances, the cellulose binder material is employed in amounts ranging from about 3% up to about 20% by weight based on the nitrocellulose constituent present, and quantities of about 10% by weight are preferred. On the other hand, the use of the cellulose binder in amounts greater than about 20% by weight has been found to effect an excessive dilution of the explosive charge, preventing the attainment of the desired burning rate and pressure of the explosive when ignited. It is for this reason that the cellulose binder material is usually employed in amounts ranging from about 3% up to about 20% by weight.

In addition to the foregoing constituents, any one or combinations of accelerators or retardants, as well as stabilizing agents of the types well known in the art, can be satisfactorily included to provide the requisite ignition, and rate-of-burn characteristics to the resultant propellant as well as to enhance its stability during prolonged periods of storage. Typical accelerating agents include water-free nitrates, while a typical stabilizing agent is represented by diphenylamine.

The mixture of the explosive constituent and binder constituent, which may be additionally include the accelerating agents, stabilizing agent, or retardants as desired, is blended with water or water and solvent in an amount sufficient to form a paste-like or doughy mass which can conveniently be molded, cast, or extruded into wet pellets of the desired configuration and size. The quantity of water employed is not critical and can be varied consistent with the shaping operation employed to achieve optimum forming characteristics. The amount of water or water and solvent employed in the mass does affect the resultant porosity of the propellant formed, since, upon evaporation of the water or water and solvent from the shaped pellet, voids are formed to a greater or lesser extent which affect the rate of burning of the propellant. The formation of a uniform wet mixture of the several constituents can be conveniently achieved in any one of a variety of mixing apparatus which preferably are provided with means for preventing or inhibiting the evaporation of water from the mass during mixing. After a substantially uniform wet mass is obtained of the desired consistency, the mass can be readly formed, preferably by extrusion, into a plurality of pellets of the desired cross-sectional configuration and of length consistent with its intended end use. The wet pellets are subsequently dried to effect a vaporization of substantially all of the water contained therein, in addition to any solvent introduced for the purpose of gelatinizing the nitrocellulose fibers employed, providing therewith a dry porous matrix consisting of the nitrocellulose fibers or granules securely bonded by the cellulose binder. The resulting propellant can be repeatedly handled, exposed to varying humidity and normal temperature conditions, and stored for long periods of time without deterioration resulting in loss of explosive power and velocity during firing.

The conditions of manufacture and use may require additional agents for special purposes. For example, the use of a stabilizer, such as diphenylamine, is generally advantageous and the use of a dye, with the exception of amine or acid dyes, for coloring the final product may be employed. A suitable oxidizing agent may be employed to provide better burning characteristics and suitable breech pressure reducing agents may be advantageously employed.

In order to further illustrate the improved propellant composition and method of making the porous propellant, the following examples are provided. It will be understood that the examples are provided for illustrative purposes and are not intended to be limiting of the scope of the present invention as herein described and as set forth in the subjoined claims.

One type of propellant suitable for use with the apparatus of the present invention is manufactured by use of water to obtain the desired degree of porosity and is sometimes referred to as a "Water System" propellant.

An exemplary formulation of such a "Water System" propellant comprises:

| | |
|---|---|
| 200 grams | Nitrocellulose (13.35% $N_2$ - 30% water by weight) |
| 1 gram | Diphenylamine |
| 5 grams | Hydroxyethyl cellulose (dry) |

-continued

| | |
|---|---|
| 10 grams | Potassium nitrate |
| 5 cc | Castor oil |
| 15 grams | Aluminum Stearate |
| 110 cc | Acetone |
| 50 cc | Water |

The nitrocellulose is a commercial grade ($N_2$ 13.35% – 13/45%) available from Hercules Powder Company. It is made from cotton linters with a fineness of 85 to 105ML and a viscosity of 8 to 20 seconds. It has an ether-alcohol solubility of 11% and is manufactured in accordance with MIL-N-244. The diphenylamine is utilized as a stabilizer as is conventional. The hydroxyethyl cellulose is sold under the trade name of Natrosol by Hercules Powder Company and has a high viscosity (e.g. 4000 centipoises) It provides a water soluble binder. Other types of water soluble binders might be used such as methyl cellulose, cellulose monochloracetate, ethyl hydroxyethyl cellulose. The potassium nitrate is utilized as an accelerator due to its ability to liberate oxygen during burning of the propellant. Castor oil is utilized for lubricating purposes both in the manufacture of the propellant during extrusion and in use in the gun. The aluminum stearate acts as an inhibitor or retardant to reduce the rate of burning and breech pressures. The acetone is a solvent for the water soluble binder and acts with the water to form a filler, which is subsequently removed to obtain the desired porosity, and to dissolve and disperse the binder throughout the nitrocellulose, the fiber structure of the nitrocellulose remaining substantially unchanged.

The method of mixing and preparing the foregoing formulation comprises initially establishing the water content of the wet nitrocellulose and adjusting the water content as necessary to obtain 30% water by weight so that the 200 grams of nitrocellulose will contain 140 grams of dry nitrocellulose and 60 grams of water. Then 200 grams of the wet nitrocellulose (water wet 30% by weight) is added to 5 grams of the hydroxyethyl cellulose (dry). The nitrocellulose and hydroxyethyl cellulose are mixed by tumbling in a closed container for approximately 10 minutes at 140°F. It is desirable to keep the mix in the container for an additional time (i.e. approximately 20 minutes) until the water soluble binder has begun to swell. Then the mix may be cooled to room temperature whereupon the potassium nitrate and the aluminum stearate are added to the mixture. Then the diphenylamine and the castor oil are dissolved in the acetone and added to the mixture. It is then desirable to tumble the mixture in a closed container for about 5 minutes and then transfer the tumbled mixture to a closed mixer for mixing approximately 30 minues. At this time, it is desirable to add 50 cc of water and mix for another 30 minutes.

As a result of the foregoing, the water soluble binder is dispersed throughout the nitrocellulose fibers in a pasty doughy mass and is ready to be molded onto the projectiles. The projectile, of the type shown in FIG. 9, is supported with a suitable die enclosing the stub shaft portion and forming a die cavity therearound approximately equal to the diameter of the projectile with suitable allowance for shrinkage and the like. The doughy mass is extruded into the die cavity around the stub shaft portion. The propellant dough is confined so that it cannot flow past the projectile and enough propellant dough is injected to fill the die cavity and produce the desired length and diameter pellet when dry. The water and acetone are then removed by evaporation to produce voids between the cotton fibers resulting in the desired degree of porosity. A quantity of this propellant equal to 85mg will propell a .22 caliber projectile of 29 grain weight with a muzzle velocity of approximately 1,200 feet persecond.

If it is desired to produce a lower velocity propellant, the following formulation may be used:

| | |
|---|---|
| 200 grams | Nitrocellulose (13.35% $N_2$ - 30% water by weight) |
| 5 grams | Hydroxyethyl cellulose |
| 10 grams | Potassium nitrate |
| 1 gram | Diphenylamine |
| 150 cc | Acetone |
| 85 cc | Water |

Figure 17:
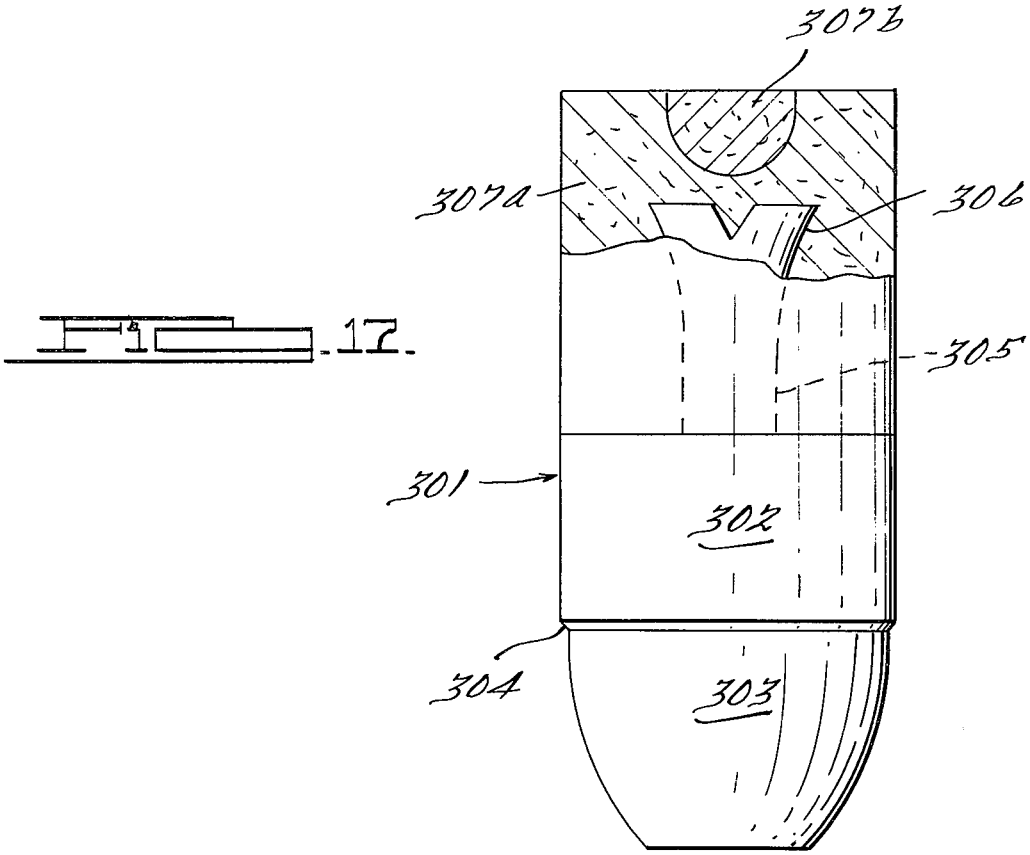
FIG. 17 is an enlarged side elevational view of a round of caseless ammunition suitable for use with the hot air ignition means of the present invention.
Figure 18:
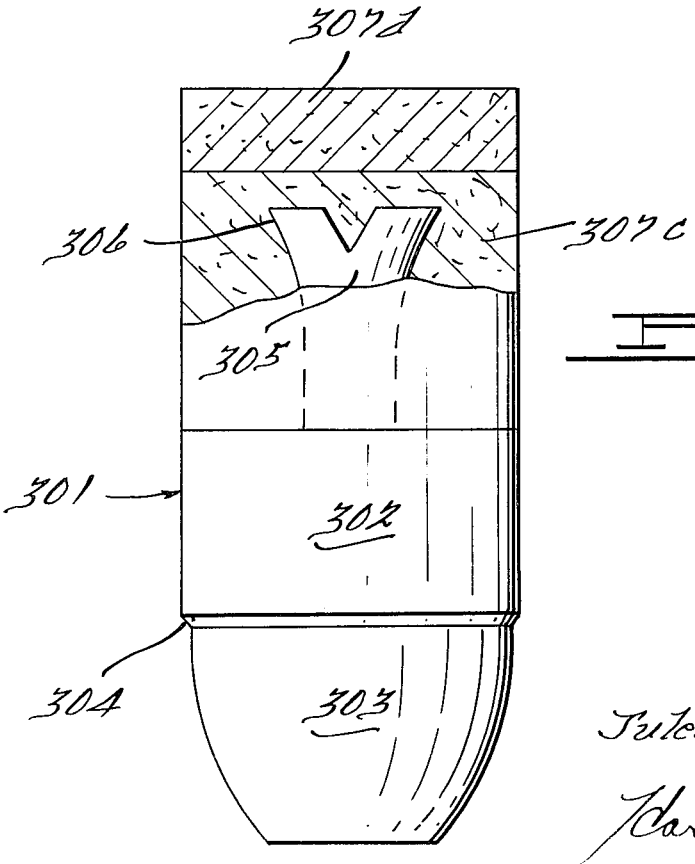
FIG. 18 is an enlarged side elevational view of another round of caseless ammunition suitable for use with the hot air ignition means of the present invention.

By mixing this formulation as hereinbefore described, a propellant producing a muzzle velocity of approximately 1100 feet per second with a 29 grain bullet will be obtained. This 1100 feet per second formulation may be used in combination with the 1,200 feet per second formulation as an ignition charge as shown in FIG. 17. The main charge 307*a* is extruded onto the projectile first as hereinbefore described. Immediately thereafter, the projectile and main charge are displaced slightly in the die means and the ignition charge 307*b* may be extruded into the rear of the main charge. In the presently preferred form, shown in FIG. 17, the ignition charge is centrally placed in the rear of the main charge in a somewhat semi-spherical form surrounded with and embedded in the main charge except for an exposed rear surface.

In order to vary the velocity, it may be desirable to change the amount of propellant of any given formulation attached to the projectile. However it is necessary and desirable to have the dimensions of the ammunition remain constant. An inert charge may be first extruded onto the projectile to occupy a portion of the volume of the normal propellant cavity. An exemplary formulation for the inert charge comprises:

100 grams Talcum
5 grams Hyroxyethyl cellulose (high viscosity)
30 grams Water

A technical grade of talcum powder such as that sold by Fisher Scientific Company has been found to be satisfactory. This mixture should be kneaded into a doughy mass for approximately 30 minutes at room temperature before being extruded. It is important that the inert dough have sufficient consistency to set up on the projectile without tending to flow past the projectile. In one illustrative arrangement, shown in FIG. 18, producing a velocity of approximately 700 feet per second with the 1,100 feet per second propellant initially described, a volume of the inert charge 307*c* equal to the projectile diameter by .130 long is molded onto the rear of the projectile. Then a quantity of the 1,100 feet per second propellant 307*d* equal to the projectile diameter by .090 long is molded onto the rear of the inert charge. This amount of the propellant will produce a velocity of approximately 700 feet per second.

Another type of propellant suitable for use with the apparatus of the present invention is manufactured by use of a salt to obtain the desired degree of porosity and is sometimes referred to as a "Salt System" propellant.

Exemplary formulations of such a "Salt System" propellant comprise:

| | | |
|---|---|---|
| A. | 100 grams | Nitrocellulose (13.34–.45% $N_2$ - dry) |
| | 200 grams | Potassium nitrate (through No. 100 sieve on No. 120 sieve) |
| | 1 gram | Diphenylamine |
| | 160 cc | Acetone |
| B. | 100 grams | Nitrocellulose (13.35–.45% $N_2$ - dry) |
| | 300 grams | Potassium nitrate (through No. 100 sieve on No. 120 sieve) |
| | 1 gram | Diphenylamine |
| | 225 cc | Acetone |
| C. | 100 grams | Nitrocellulose (13.35–.45% $N_2$ - dry) |
| | 400 grams | Potassium nitrate (through No. 100 sieve on No. 120 sieve) |
| | 1 gram | Diphenylamine |
| | 300 cc | Acetone |

The nitrocellulose is a commercially available grade ($N_2$ 13.35% – 13.45%) sold by Hercules Powder Company as hereinbefore described. The potassium nitrate is used as a filler which is subsequently removed to produce the desired porosity in the propellant. The diphenylamine is a stabilizer, as is conventional, and the acetone is a solvent which destroys the fiber structure of the nitrocellulose and forms a doughly mass.

The method of mixing and preparing the foregoing propellant formulations comprises pre-blending of the diphenylamine and the acetone and then mixing of the entire formulation in a closed container for about 1 hour. The consistency of the propellant may be improved by extruding the mass several times. It is important to maintain uniform extrusion speed. After the final extrusion, which may be the fifth extrusion, the extruded material may be hung to dry at room temperature for approximately 15 hours to minimize dimensional distortion. The propellant material may be extruded in a tubular form. For a propellant of type A, a 0.250 inch nozzle and a 0.062 inch pin are utilized so that, after washing and drying, the outside diameter of the propellant will be about 0.220 inches and the inside diameter will be about 0.045 inches. When the material has been dried, it is cut to lengths of about 0.169 inches with a 0.010 wide slotting saw. A propellant pellet of approximately 157 mg is thus provided which, after washing, will weigh about 50 mg. After cutting, the potassium nitrate is removed from the pellets by washing the pellets for approximately 4 days in slowly running water at about 140°F. Thereafter, the propellant pellets are dried for approximately 24 hours and then the still wet propellant may be pressed onto the post at the rear of the projectile. The 157 mg (50 after washing) pellet of propellant will produce velocities of approximately 1,100 feet per second on a projectile weighing 1.93 grams. It is to be understood that the propellant also may be extruded onto the projectile or molded thereon.

Still another type of propellant suitable for use with the apparatus of the present invention is manufactured by use of a solvent in place of the water-acetone in the water system to obtain the desired degree of porosity and is sometimes referred to as a "Solvent System." An exemplary formulation of such a "Solvent System" propellant comprises:

| | |
|---|---|
| 100 grams | Nitrocellulose (13.35% –.45% - dry) |
| 1 gram | Diphenylamine |
| 125 cc | Toluene |
| 20 cc | Alcohol (denatured or isopropylalcohol) |
| 25 cc | Acetone |
| 5 grams | Aluminum stearate |
| 5 grams | Ethyl cellulose (high viscosity - K 5000) |
| 1.87 grams | Potassium nitrate |

The nitrocellulose is a commercially available grade as hereinbefore described. The diphenylamine acts as a stabilizer and the aluminium stearate acts as a retardant to reduce breech pressures. The toluene is a liquid filler by which the desired degree of porosity is attained. Other suitable liquid fillers include benzene and xylene. The alcohol is utilized to prevent the toluene from reacting with the nitrocellulose. The actone is utilized to partially react with the nitrocellulose causing the nitrocellulose to swell and expand without destroying the fiber structure. The ethyl cellulose acts as a binder for the liquids so as to produce a doughly mass. The potassium nitrate acts as an accelerator producing oxygen during burning.

The method of preparing the propellant comprises mixing the toluene, alcohol, and acetone, and then adding the ethyl cellulose and the diphenylamine. This mixture is then thoroughly mixed for approximately 2 hours at room temperature so that the ethyl cellulose is entirely dispersed in the solvents. Then the dry nitrocellulose and aluminum stearate are added and mixed for approximately 1 hour. At this time, the propellant is in the form of a doughly mass ready for molding into a tubular form for subsequent association with the projectile or for direct molding into projectile as hereinbefore described. After the molded pellets have been at room temperature for about 5 minutes, they are boiled in a 2-½% potassium nitrate water solution for approximately 15 minutes and are then dried at 140°F. Boiling of the pellets in the $KNO_3$ - water solution reduces shrinkage and increases the rate of removal of the solvents to produce the voids in the propellant. Consequently, no further rinsing is required and the remaining $KNO_3$ will act as an oxidizing agent during burning of the propellant.

Advantages of these propellants are that they may be economically manufactured, they are stable both in manufacture and use under normal conditions, they may be easily associated with a projectile to form "caseless" type ammunition, and they will burn cleanly and minimize corrosion of the gun parts. Furthermore, while being stable and harmless in association with a projectile during manufacture, storage, and handling, when properly positioned in a firing chamber of a gun, they are capable of being ignited and generating high energy gases, which when properly confined, are capable of propelling a projectile through a gun barrel at high velocity. While the propellant attached to the projectile can be ignited in the open by a flame from a match or the like, the propellant merely burns at a slow rate causing no movement of the projectile and is completely harmless. In addition, the propellants and the methods of making them provide versatility and flexibility to enable propellants of varying degress of porosity to be obtained in a manner which is simpler and more economical than previously known.

Referring again to FIG. 6, the rotating cylinder 228 is sequentially indexed to present a new round and projectile cavity 272 in line with the barrel 223 upon cocking of the gun by a ratchet drive mechanism indicated generally by the reference numeral 308. The ratchet drive mechanism includes a cylinder 309 press fitted within a bore 311 formed in a part of the recever 221. A generally cup-shaped ratchet drive 312 (FIG. 15 and 16) is journaled upon the cylinder 309 for both rotary and axial movement. The axial bore 271 of the rotating cylinder 228 also slidably receives the ratchet drive 312 so that the rotating cylinder also is rotatably supported upon the cylinder 309 through the ratchet drive 312. A plurality of teeth or serrations 313 (FIG. 7) are formed at one end of the ratchet drive and cooperate with complementary serrations 314 formed in the face of the revolving cylinder 228 at the base of the bore 271.

Serrations 313 surround a square aperture 315 (FIG. 15) formed in the end of the ratchet drive. A ratchet actuator shaft 316 (FIGS. 6–8) is supported beneath the barrel 223 and extends coaxially through a bore 317 in the cylinder 309 and through the square aperture 315 in the ratchet drive 312. The shaft 316 has a generally square cross section and is formed with a twisted portion 318. An outer straight end portion 319 of the ratchet actuator shaft is affixed within a bore 321 formed in a depending projection 322 of the cylinder head 233 by a snap ring 323 and a thrust washer 324. A coil spring 325 is interposed between the ratchet drive 312 and the receiver 221 around the cylinder 309 to urge the ratchet drive 312 and rotating cylinder 228 in a rearward direction toward the cylinder 231.

Figure 12:
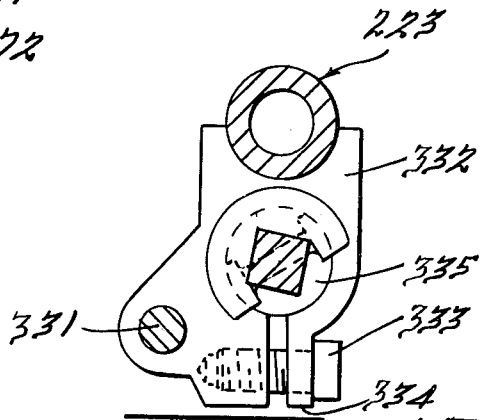
FIG. 12 is a cross-sectional view taken along the line 12—12 in FIG. 7.
Figure 13:
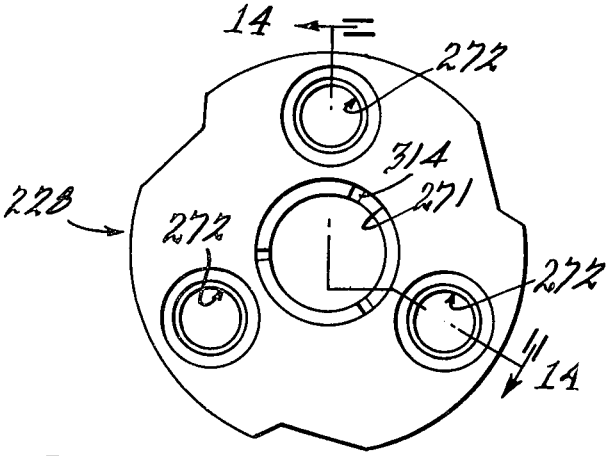
FIG. 13 is an enlarged end view of a portion of the apparatus shown in FIG. 5.
Figure 14:
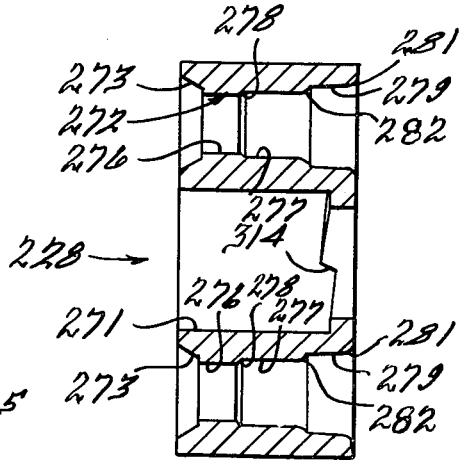
FIG. 14 is a cross-sectional view of the part shown in FIG. 13.
Figure 15:
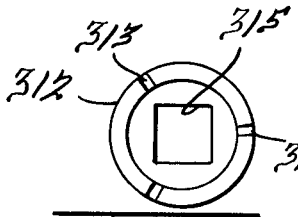
FIG. 15 is an enlarged end view of another portion of the apparatus shown in FIG. 5.
Figure 16:
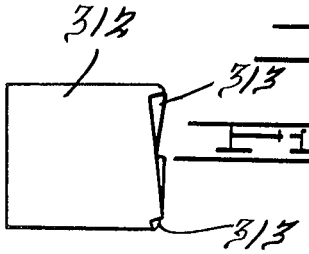
FIG. 16 is a side elevational view of the part shown in FIG. 15.

The ejector mechanism 229 comprises an ejector rod 331 affixed to an adjustable mounting bracket 332 (FIG. 12). A screw 333 is threaded to a split end 334 of bracket 332 to tighten the bracket onto a shaft 335 supported for reciprocation in the receiver beneath the barrel. A coil spring 336 (FIGS. 7 and 8) engages the bracket 332 and a fixed abutment 337 (FIG. 5) to normally urge the bracket and ejection rod 331 in a rearward direction toward an ejection position. The front end of the ratchet actuator shaft 316 is received in a complementary cavity 338 formed in the rear end of the shaft 335. Normally, the end of the shaft 316 abuts the bottom of the cavity 338 to urge the ejector rod 331 in a forward direction and compresses spring 336.

FIG. 5 illustrates the gun in its cocked position ready for firing. To fire the gun, the trigger 259 is pulled causing it to pivot in a counterclockwise direction about the pivot pin 260. Projection 264 contacts depending arm 265 of lever 266 to rotate it in a clockwise direction whereby detent 268 moves free of the notch 269 in sear 241. The force of the coil spring 238 upon the piston 235 overcomes the action of the latch 241 and the piston may be driven into the cylinder 231 by the spring to compress the air therein. Air under increased pressure and temperature enters the ignition chamber through the passages 289, 291. The ball valve depending upon its initial position, is either forced away from the valve seat or maintained away from the valve seat by the high pressure air and the flow passage between the ignition chamber and the compression chamber is kept open until the pressure in the ignition chamber becomes greater than the pressure in the passages 289, 291 due to leakage of air past the piston at the end of the compression stroke. When the pressure differential is attained, the ball valve 293 is moved onto the valve seat 292 and the passage 289 is closed. It has been found that ignition of the propellant will ordinarily occur after the valve is closed due to an ignition time delay apparently equal to the time necessary to transfer heat from the air to the propellant and raise the temperature of the propellant to the ignition temperature. The front of the ammunition round 301 provides a seal in the bore 277 and on the shoulder 278 so that the high temperature ignition air cannot leak past the round. When the round begins to move, lead on the projectile portion 302 is compacted to permit movement past shoulder 278 and, as the projectile moves into the barrel, it has been found that some of the lead will be removed from the projectile and forced into the lead collecting groove 274. Consequently, upon subsequent firings, there will be an accumulation of lead in the groove and a lead seal will be established between the barrel and the cylinder. The high temperature of the air within the ignition chamber ignites the propellant 307 and the projectile 301 is driven out of the barrel bore 224 at a high velocity. The ball check valve 293 is driven against its seat 292 so that the products of ignition will not enter the air compression cylinder 231 through passages 289, 291.

To prepare the gun for the next firing operation, the cocking lever 256 and pivot pin 253 are rotated in a clockwise direction about pivot 255 causing link 251 to be drawn rearwardly and exerting a rearward force upon the supporting pin 248 of pinion gear 245. Pinion 245 then walks along the stationary rack 247 and causes the rack 246, that is integral with the cylinder 231, to be driven in a rearward direction. The cylinder 231 is moved rearwardly and forces the head of the piston 235 rearwardly through contact with the resilient disk 234. Thus, rotation of the cocking lever 256 causes the piston 235 and cylinder 231 to be moved rearwardly simultaneously.

When the piston 235 reaches its cocked position, the sear 241 engages with protuberance 244 and retains the piston 235 in its cocked position. The cocking lever 256 will then have reached the end of its pivotal movement in a clockwise direction. It is returned to its normal position by rotating it in a counterclockwise direction and cylinder 231 will again be returned to the firing position.

As has been previously noted, revolving cylinder 228 is held from rotation by the contact of the obturator portion 288 with the tapered bore 279 and contact of the chamfered end 275 of the barrel with the chamfer 273. When the gun is being cocked, air compression unit 225, the cylinder 231, and obturator 285 are moved to an ammunition loading position away from the revolving cylinder 228. The coil spring 325 acting through the ratchet drive 312 then urges the revolving cylinder 228 away from its firing position in engagement with the barrel 223 toward a loading position until it contacts a suitable stop 340 (FIG. 7). As the cylinder head 233 draws rearwardly, the shaft 316 passes through the square aperture 315 in the ratchet drve 312. Once the revolving cylinder 228 contacts its stop, the obturator portion 288 will move away from the tapered bore 279 freeing the revolving cylinder for rotation. Then the twisted portion 318 of the shaft 316 enters the aperture 315 and the ratchet drive 312 is rotated. The rotary motion of the ratchet drive is transmitted through the ratchet teeth 313 to cause rotation of the rotatable cylinder 228. The configuration of the ratchet teeth 313 and the twisted section 318 of the shaft 316 is such that the revolving cylinder 228 will be indexed sufficiently to bring the next ammunition chamber 272 into alignment with the barrel 223.

A pivotally supported locking pawl 341 (FIG. 11) is biased by a coil spring 342 into engagement with serrations 343 formed around a periphery of the revolving cylinder 228. The spring 342 and direction of the serrations 343 is such that the revolving cylinder 228 may rotate freely under the action of the pawl 312 when it is being indexed. The indexing also occurs during the portion of the cocking of the air compression unit 225 that positions the piston 235 in its cocked position. When the cylinder 231 is being returned to the firing position, the shaft 316 will again traverse the rectangular aperture 315 of the ratchet drive 312. The locking pawl 341, however, will prevent rotation of the cylinder 228 at this time due to its locking action. The ratchet teeth 313 then disengage from the serrations 314 in the cylinder 228 to permit relative rotation.

Rotation of cylinder 228 terminates before the end of the cocking action and the forwardmost straight portion of the actuator rod 316 enables the rod to be further pulled through the ratchet mechanism. At the end of the cocking movement, the ejector rod is forced into the ammunition chamber 272 (FIG. 8) which chamber has just previously been in registry with the barrel 223 and indexed from a firing position to an ejection position during the cocking movement. When the actuating shaft 316 is being moved rearwardly, the coil spring 336 urges the lever 332 and ejector rod 331 into the chamber 272. In the event that the previous round was not fired, the ejector rod 331 will drive any unspent round or portion thereof from the ammunition chamber to prevent jamming of the gun to allow for unloading the gun. When the cylinder 231 is returned to the firing position, the forward end of the shaft 316 will abut the bottom of the cavity 338 formed in the shaft 335 to return the ejector rod 331 to its inactve position.

When the cocking lever 256 is returned to its normal position and the cylinder 231 is returned to the firing position, the tapered portion 288 of the obturator 285 will again reenter the tapered bore 279 of the next successve projectile cavity in the revolving cylinder 228. This operation will serve to center the cylinder 228 with respect to the barrel 223 and obturator 285. The axial movement of the cylinder 231 again compresses the spring 325 and returns the transfer mechanism to the firing position ready for discharge as shown in FIG. 6.

Any suitable axially discharging loading mechanism (not shown) may be provided within the receiver of the gun to insert a new round into the next succeeding projectile cavity 272 of the rotating cylinder 228 during return movement of the cylinder 231 to the firing position. The loading mechanism, which may be similar to the ejection mechanism previously described but reversely operating, may take the form of a rod movable with the compression cylinder 231 through a spring operated magazine of conventional design.

Figures 19, 20:
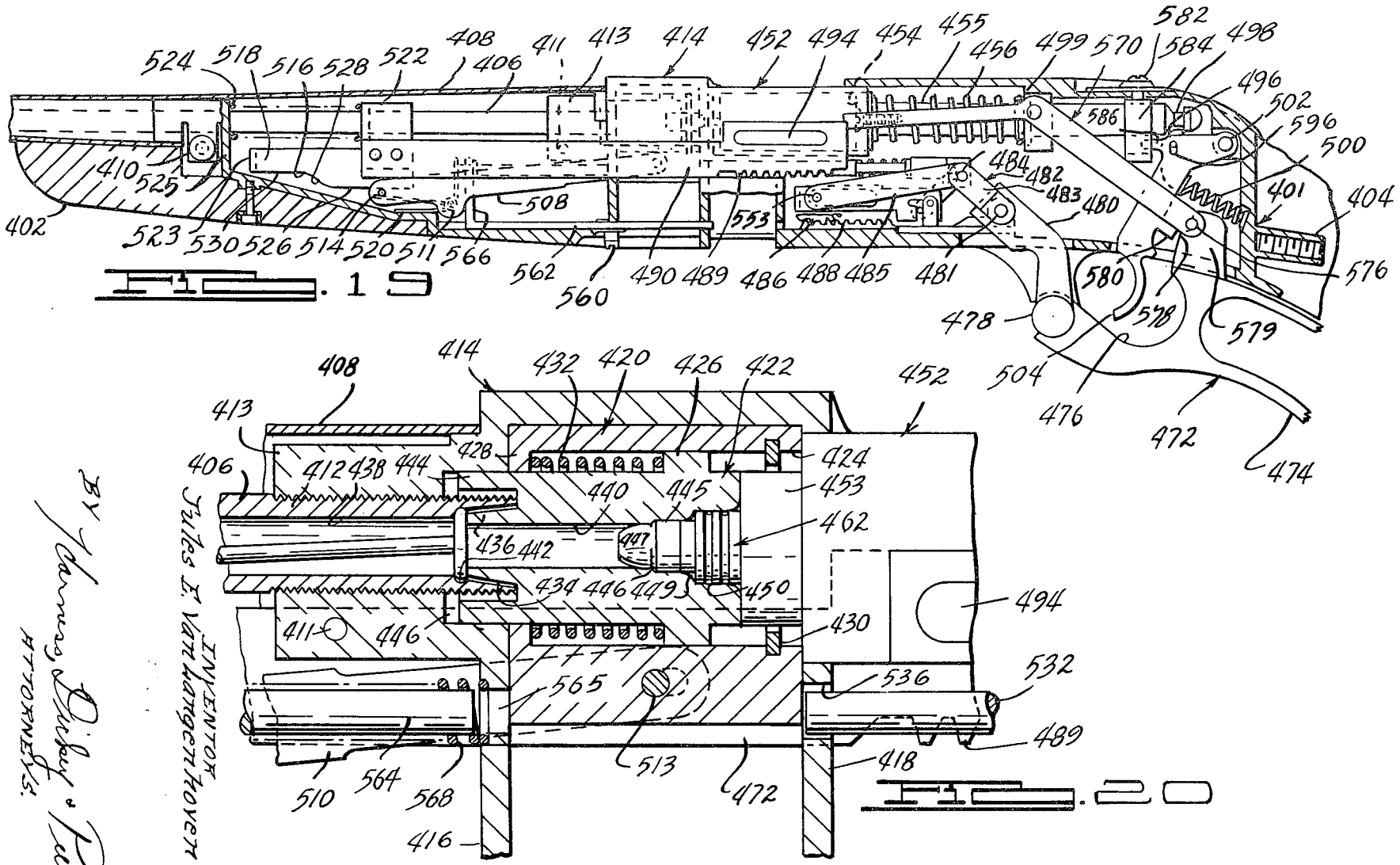
FIG. 19 is a side elevational view of a presently preferred embodiment of certain of the inventive principles in a gun.
FIG. 20 is an enlarged partial sectional view of a portions of the apparatus shown in FIG. 19.

Referring now to FIGS. 19–25, a presently preferred embodiment of certain of the inventive features in a gun is shown. A receiver casting, or the like 400, (FIG. 19) mounts a forearm support 402 and the stock (not shown) is adapted to be mounted on a threaded rearwardly extending stock sleeve 404. A barrel 406 and a barrel shroud 408 are mounted on the receiver as by clamping screw means 410, 411. The rear end 412 of the barrel means (FIG. 20) is threadably received in a hub portion 413 of a housing 414 mounted on the receiver. Parallel vertically extending front and rear guide plates 416, 418 form part of the housing and define a guideway for ammunition transfer means in the form of vertically movable elevator means 420. Firing chamber forming means in the form of a tubular member 422 is reciprocably mounted in the elevator member 420 for axial movement between a firing position and a loading position. As shown in FIG. 20, a central bore 424 in the elevator member slidably receives a centrally located guide flange portion 426 extending radially outwardly from the firing chamber member and confined between a flange abutment 428 at one end of the bore and a retaining ring 430 at the other end. Compression spring 432 biases the firing chamber member toward the loading position (not shown) whereat the firing chamber member is centrally located in the elevator member between the side surfaces of the guide plates 416, 418.

In the raised position of the elevator member, shown in FIG. 20, the firing chamber member provides breech means axially aligned with and forming a continuation of the rear end of the barrel means. A conically tapered chamber 434, at the rear of the barrel, is adapted to snugly receive a correspondingly tapered nose portion 436 on the front end of the firing chamber member to connect and align the barrel bore 438 with a corresponding bore 440 in the firing chamber member. An enlarged groove 442 is provided at the end of the tapered chamber 434 between the barrel bore 438 and the firing chamber bore 440, and serves to collect lead from the projectiles being fired. Obturation means for sealing the firing chamber member relative to the barrel means during firing of a projectile are provided by the conical chamber 434, conical nose portion 436, and lead collecting groove 442. A sleeve portion 444 surrounds the tapered nose 436 and defines a groove into which the end of the barrel is received in the firing position. A counterbore 446 in the hub portion 413 accommodates the firing chamber member in the firing position.

Figure 24:
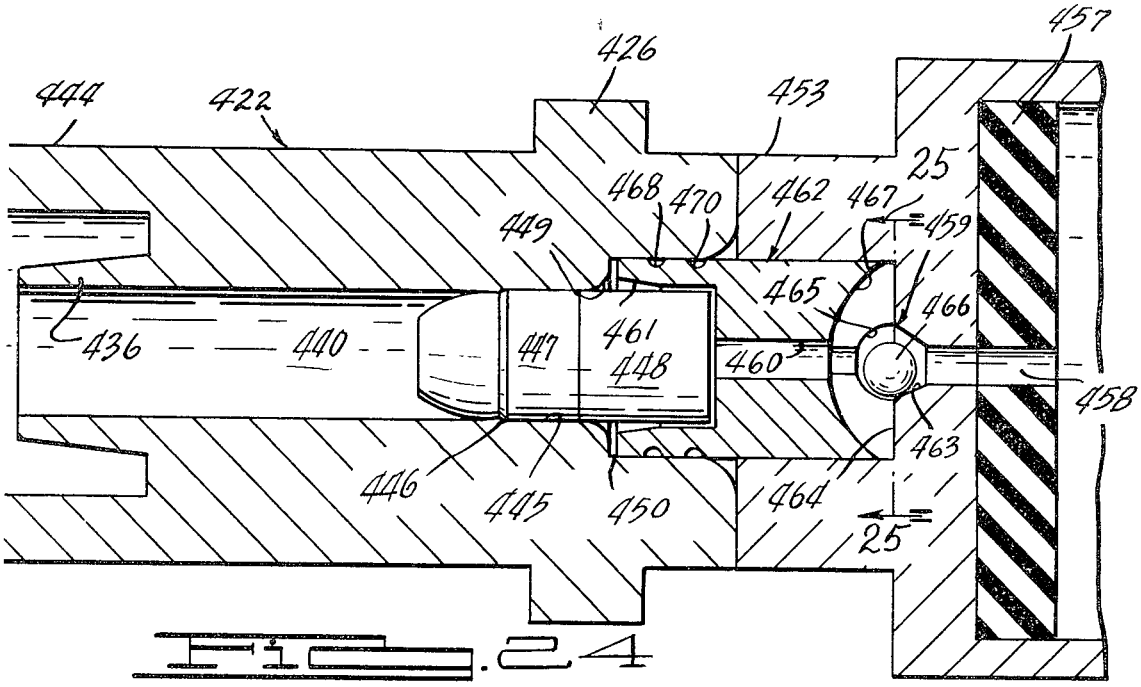
FIG. 24 is an enlarged sectional view of a portion of the apparatus shown in FIG. 19 illustrating a round of ammunition in firing position.
Figure 25:
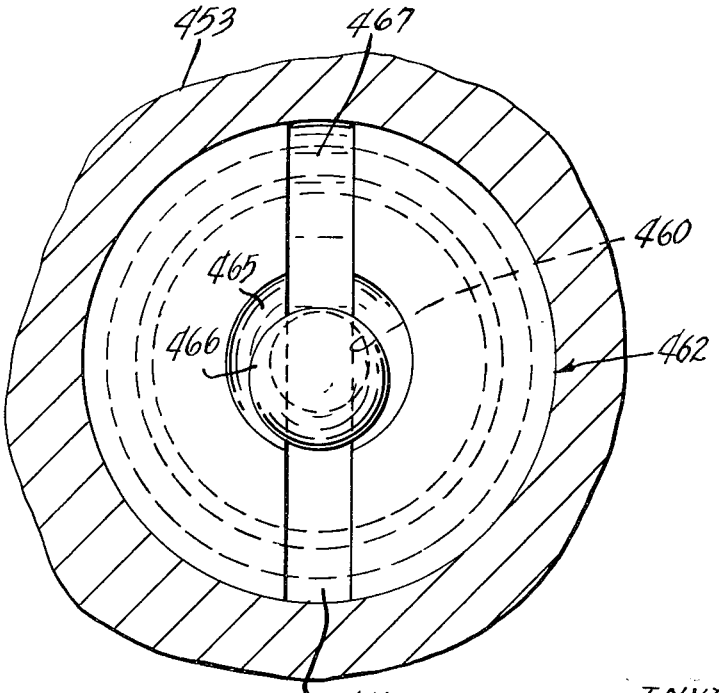
FIG. 25 is a sectional view of a portion of the apparatus shown in FIG. 24.
Figure 29:
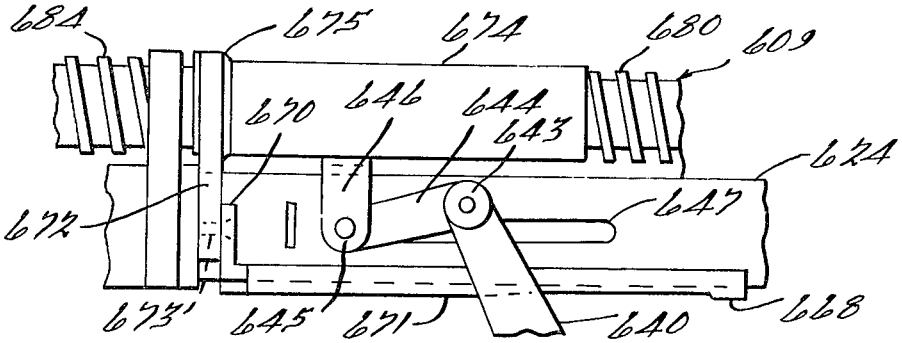
FIG. 29 is an enlarged side elevational view of a portion of the apparatus shown in FIG. 26.

The rear portion of the bore 440 terminates in an enlarged portion 445 providing a shoulder 446 for receiving and holdng the ammunition in the firing chamber member in the manner shown in FIG. 24. The metallic (lead) bullet portion 447 is seated and sealed on the shoulder 446 with a cylindrical central portion in bore 445. The propellant portion 448 extends from the enlarged bore portion 445 and terminates forwardly of a shoulder 449 formed by an enlarged obturation chamber 450 in the rear end of the firing chamber member.

Figure 21:
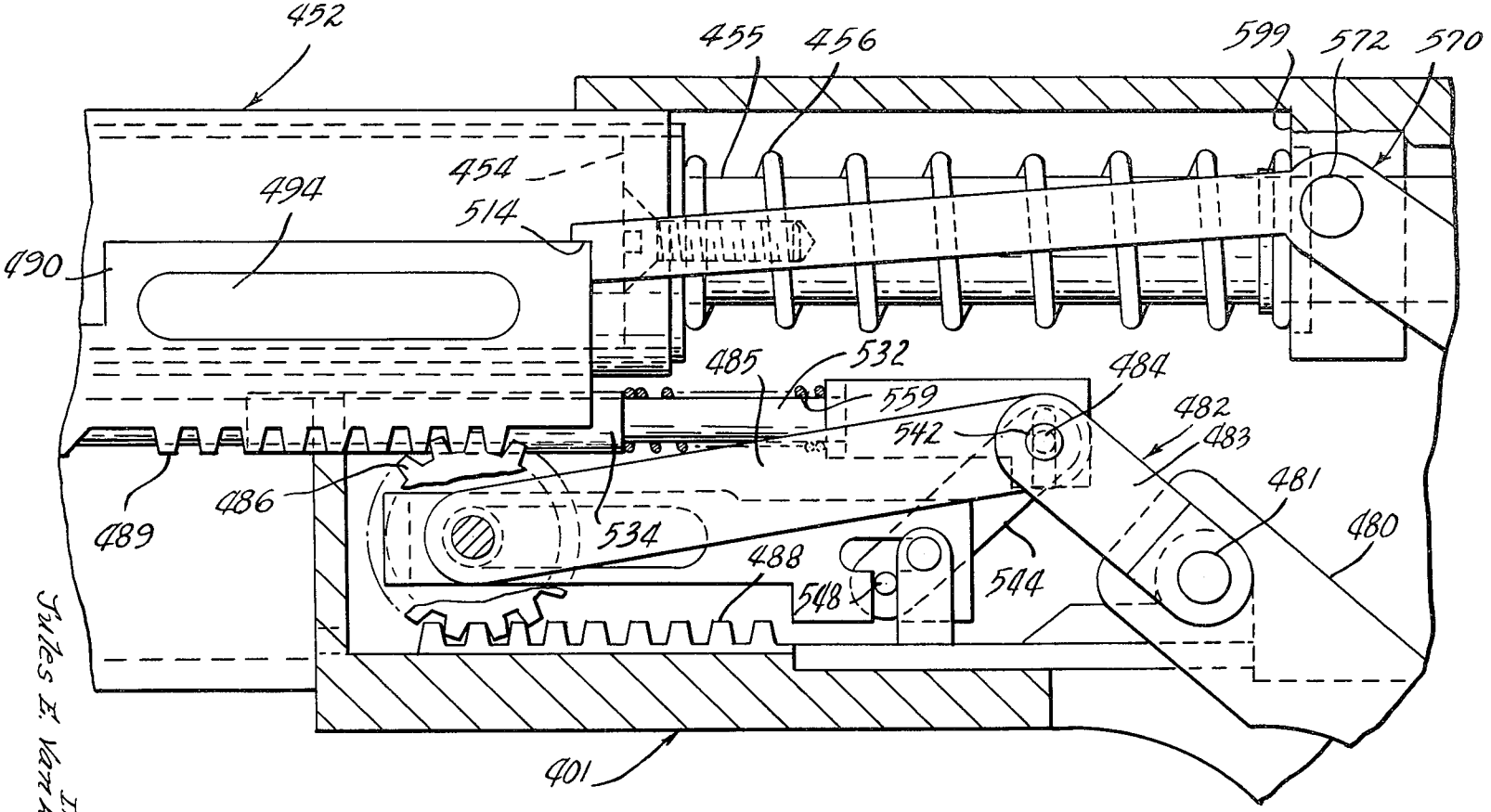
FIG. 21 is an enlarged partial sectional view of another portion of the appartus shown in FIG. 19.

Referring now to FIGS. 19 and 21, ignition means for igniting the propellant comprises an air compression cylinder 452 having a piston 454, attached to a rearwardly extending piston rod 455, reciprocably mounted therein to compress and heat air to a temperature sufficiently high to ignite the propellant by surface contact therewith. A compression spring 456 is provided to drive the piston from a retracted cocked position (shown in FIG. 19) to an extended position bottomed on a cushion disk 457 (FIG. 24) in the front end of the cylinder. Referring now to FIG. 24, the cylinder head is provided with a restricted passage 458 which is connected through valve means 459, in breech means defined by a forwardly projecting hub portion 453, and passage means 460 to firing chamber means 461 formed by a cylindrical cavity in obturation means 462 which may be fixedly secured in place by a press fit or the like. A valve cavity is formed between a conical valve seat 463 in the bottom of an obturation cavity 464 and a hollow 465 in the rear of the obturation means 462. A valve, in the form of a ball valve 466, is floatingly mounted in the valve chamber and is movable onto the valve seat 463, facing the firing chamber, to close the passage 458 when the pressure on the firing chamber side of the valve seat exceeds the pressure on the compression chamber side of the valve seat. The obturator may be slotted, 467 FIG. 25, to provide for adequate communication between passages 458, 460. The valve operates as hereinbefore described.

The obturation means 462 is provided with a cylindrical projection adapted to be snugly received in the obturation chamber 450. Sealing grooves 468, 470 are provided around the periphery of the cylindrical projection to prevent escape of high pressure fluids from the firing chamber. The obturation means is preferably made of a material, such as berrylium copper, which will expand and contract rapidly under pressure to aid in forming the seal. The spring 432 (FIG. 20) biases the firing chamber toward the obturation means during engagement of the obturation means as hereinafter described in detail.

Referring now to FIGS. 19 and 21, cocking means are provided to condition the gun for firing of the ammunition and include a cocking lever 472, having a handle portion 474 and a trigger portion 476, pivotally mounted on the receiver at 478. A connecting lever portion 480 extends into the receiver and is pivotally connected at 481 to a bifurcated connecting yoke 482. Each leg 483 of the yoke is pivotally connected at 484, on opposite sides of the lever portion 480, to a link 485 having a pinion 486 rotatably journaled thereon. Each pinion 486 is rotatably mounted between a lower rack element 488 fixed to the receiver and an upper rack portion 489 of spaced parallel actuating bar means 490, 492 which are fixedly secured to projections 494 on the compression cylinder 452 and form carriage means therefor. Consequently, as the cocking lever is pivoted downwardly, the lever portion 480, the yoke 482, the links 485, and the pinions 486 are moved rearwardly. Rotation of the pinions on the fixed racks 488 causes rearward movement of the upper rack portions 489 to move the compression cylinder 452 and the piston rod 455 rearwardly to the position shown in FIG. 22 whereat a sear 496 (FIG. 19) is retainingly received in a notch 498 in the rod. Compression spring 456 is compressed against the receiver abutment 499 through which the piston rod slidably extends. A sear spring 500 biases the sear to the latched position about the pivot 502. A trigger 504 pivotally mounted at 502, releasably engages the sear by means of a pin and slot connection 506 so that rearward movement of the trigger against the bias of the sear spring 500 pivots the sear 496 downwardly and releases the piston rod for forward movement under the urging of the compression spring 456.

Return upward pivotal movement of the cocking lever moves the lever portion 480, the yoke 482, the links 485, and the pinions 486 forwardly. Rotation of the pinions on the fixed racks 488 causes forward movement of the upper rack portions 489 to return the compression cylinder to the firing position shown in FIGS. 19, 20, and 21.

Figure 22:
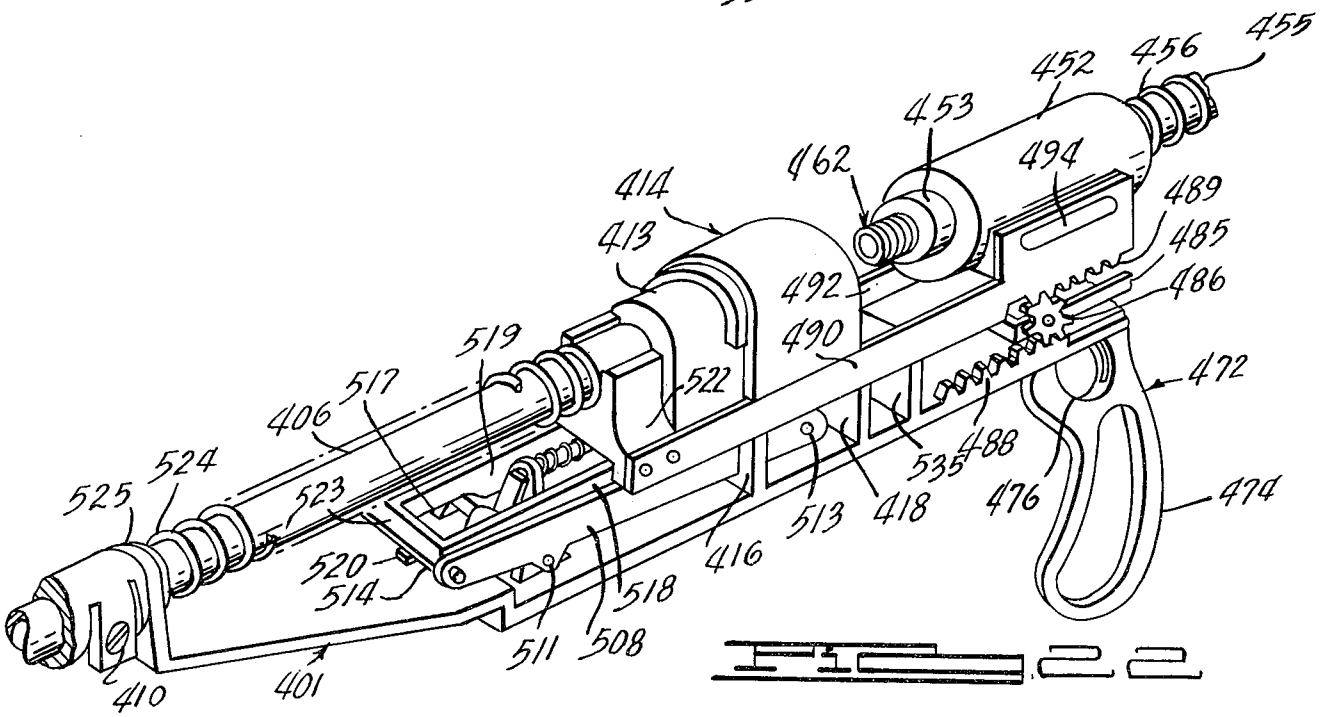
FIG. 22 is a schematic perspective view of portions of the operating mechanism of the apparatus shown in FIG. 19.

Ammunition loading means are provided to load the firing chamber member while the gun is being cocked and the compression cylinder is being moved from the firing position to the loading position and back to the firing position. In order to load a round of ammunition in the firing chamber, the firing chamber member is displaced to a loading position by actuation of transfer means 420 through elevator mechanism actuated simultaneously with the compression cylinder by the cocking means. An elevator lever is formed by spaced parallel links 508, 510 (FIG. 22) pivotally mounted to the receiver at 511. Each link is pivotally connected to the transfer means 420 at one end by a suitable pin and slot connection 513 (FIG. 20) so that, as the links are pivotally moved upwardly and downwardly, the transfer means is reciprocated vertically along guide plates 416, 418 between a raised firing position (FIG. 20) and a lowered loading position (FIG. 22).

Pivotal movement of the elevator links is attained by engagement of cam follower means attached to the links with cam means operated by the cocking lever. In the illustrative embodiment, the cam follower means is in the form of roller means 514 (FIG. 22) mounted between the ends of the links 508, 510 and biased into engagement with cam surfaces 516 (FIG. 19), 517 (FIG. 22) on cam plates 518, 519 by spring means 520. A slide 522 is slidably mounted along the bottom of the barrel and fixedly supports the forwardly extending cam plates 518, 519 which are also interconnected by a cross brace 523. Actuating bars 490, 492 extend forwardly through guide slots formed in the guide plates 416, 418 and are connected to the slide 522 so that the slide is reciprocably actuated along the barrel as the gun is cocked. An assist spring 524 is mounted on the barrel between a receiver abutment 525 and the front face of the slide. The cam surfaces (FIG. 19) are provided with a first horizontally extending straight portion 526, an intermediate curved portion 528, and a terminal horizontally extending straight portion 530. Thus, during the first portion of the cocking operation, the cam follower travels along the straight portion 526 of the cam surface with no pivotal movement being imparted to the elevator levers 508, 509 and no vertical movement being imparted to the elevator member 420. The length of the straight portion 526 is sufficient to enable the obturation means 462 on the compression cylinder to be withdrawn from the obturation chamber 450 in the firing chamber element 422 and to clear the elevator member 420. As the obturation means are withdrawn, the compression spring 432 in the elevator member also releases the obturation means between the firing chamber member 422 and the barrel and positions the firing chamber member within the confines of the elevator member. When the cam follower means 514 reaches the curved portion 528 of the cam surface, the cam follower spring is effective to cause pivotal movement of the elevator levers resulting in lowering movement of the elevator member in its guideway. The elevator member bottoms before the end of the cocking action and the straight cam portion 530 at the top of the curved portion permits continued movement of the cam plates 518, 519 without imparting additional movement to the elevator member.

Figure 23:
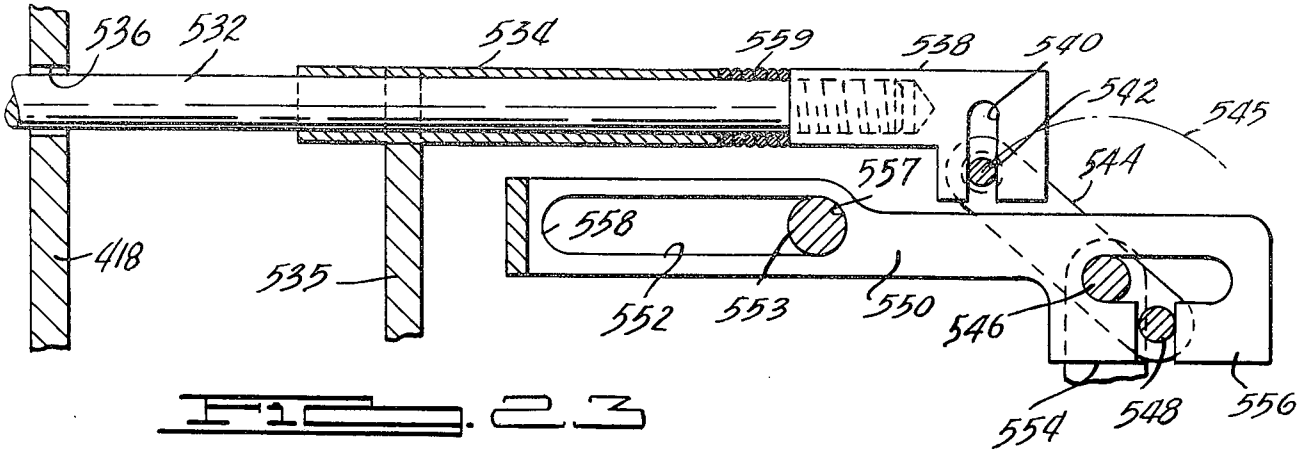
FIG. 23 is an enlarged sectional view of another portion of the apparatus shown in FIG. 19.

Loading means mechanism, shown in detail in FIG. 23, is operative only after the elevator mechanism has lowered the elevator member. A reciprocably mounted loading rod 532 is slidably journaled in a tubular support 534 in the receiver for movement between an extended position and a retracted position. In the extended position, the loading rod extends through clip type magazine means (not shown), which may be provided with rotary or axial feed mechanism, mounted between the guide plate 418 and a guide plate 535 through a suitable opening in the bottom of the gun. The loading rod slidably removes a round of ammunition from the magazine and pushes the round into the firing chamber member through a loading port 536 in the guide plate 418. Actuating mechanism is connected to the loading rod by a clevis member 538 having a vertically extending slot 540 in each leg. A cross-pin 542, supported on each side by actuating links 544, is mounted in the slots 540 and rotated along an arc 545 between axially spaced positions. The slots permit straight line reciprocating movement to be imparted to the loading rod by pivotal movement of the links 544. Each link is pivoted on the receiver at an intermediate point 546. Cross-pin 548 extends between the lower ends of the links 544 for engagement with an actuator link 550. An elongated slot 552, at one end of the actuator link, is adapted to receive a cross-shaft 553 extending between the pinions. Downwardly depending lug portions 554, 556 are provided at the other end of the actuating link for driving engagement with the cross-pin means 548. The arrangement is such that the cross-shaft 553 does not engage the end 557 of the slots 552 until after the elevator has been lowered. When the cross-shaft 553 does engage the end 557 of the slots, the actuator link 550 is moved rearwardly causing lug 554 to move the cross-pin means 548 rearwardly and rotate the links 544 about their pivot 546 to drive the loading rod forwardly through the magazine clip and carry a round of ammunition to the firing chamber member in the elevator means during the terminal position of the movement of the cocking lever from its retracted position (FIG. 19) to its extended position (FIG. 22). A return spring means 559 is provided to immediately withdraw the loading rod at the beginning of the return movement of the cocking lever from the extended position to the retracted position. During reverse movement at the end of the cocking operation, the cross-shaft means 553 engages the other end 558 of the slots and pulls the rear lug 556 and the cross-pin means 548 forwardly to complete rotation of the actuating links 544 in the opposite direction which returns the loading rod to the retracted position enabling another round of ammunition to be fed into alignment with the loading rod in the magazine.

In order to eject a round from the gun, if necessary, the magazine clip is removed and manually operable ejector mechanism is provided to clear the firing chamber member. Referring again to FIGS. 19 and 20, a knob 560 is connected to a slide 562 slidably mounted on the receiver and having an ejector rod 564 (FIG. 20) mounted on an upwardly extending flange 566 (FIG. 19). Rod 564 is aligned with an opening 565 in the front guide plate 416 aligned with the loading port 536 in the guide plate 418. A compression spring 568 may be mounted between flange 566 and plate 416 to bias the ejection rod to the retracted position. By pulling the knob 560 rearwardly, the ejection rod is moved rearwardly through the plate 416 and, when the elevator mechanism is down, into the bore 440 of the firing chamber member whereat a round in the firing chamber will be engaged and driven rearwardly through the loading port 536 for discharge through the magazine cavity.

Referring now to FIGS. 19 and 21, lock bar means 570 for locking the compression cylinder in the firing position are pivotally mounted on the receiver at 572. A notch 574, at the forward end, is adapted to abuttingly engage the rear of the plates 490, 492 while a cross-pin 576 at the other end engages a cam surface 578 on a projection 579 of the cocking lever which is operative to cam the lock bar means into locking position in the closed position of the cocking lever. When the cocking lever is open, cross-pin 576 on the lock bar means engages the trigger abutment 580 and prevents release of the sear until the cocking lever has been closed.

A conventional safety including a manually operable slide 582 and a locking ring 584 may be provided to selectively prevent release of the sear by positioning the ring about a projection 586 on the sear.

Referring now to FIGS. 26–32, certain of the inventive principles are shown to be embodied in an illustrative powder actuated stud driving tool comprising a handle portion 600 formed from complementary handle halves 601, 602 (FIG. 28) and connected to a barrel portion 604 (FIG. 26) in which air compression means 606 are connected through valve means in a breech block assembly 607 to bore 608 of a barrel assembly 609.

The air compression means 606 comprises a compression chamber 610 in which a piston 611 is reciprocably mounted on a piston rod 612 extending forwardly through the front wall 613 of the cylinder means and being connected at its forwardmost end to a return piston assembly 614 for automatic cocking of the tool. Compression spring means 616 is mounted about the piston rod and compressibly retained between a slidable sleeve element 618, abutting the return piston assembly, and the front wall 613 of the compression cylinder. A spring cushion arrangement 622 is mounted on the front of the return piston means to cushion the bottoming of the return piston assembly 614 at the front end 623 of the return cylinder means 624. As shown in FIG. 27, cylinder means 624 is provided with a high pressure inlet passage 626 connected to the barrel bore 608 through a passage 628 controlled by an adjustable valve 630. Thus, high temperature, high pressure gases, generated when the tool is fired, may be conducted into the return cylinder means 624 to cock the gun as will be hereinafter described in detail. After such a high pressure cocking operation, the gases in the cylinder 624 cool to reduce the pressure and the passage 628 to the barrel remains open so that during subsequent air compression in chamber 610 the return piston assembly 614 is freely movable.

A manual cocking mechanism is also provided and includes a cocking lever assembly 636 releasably mounted at the front of the handle assembly by suitable catch means 637. The lever assembly comprises a main body portion 638 connected at 639 to an actuating link 640 pivoted at 641. An operating handle extension 642 is slidably mounted on the body portion and may be downwardly displaced to increase the mechanical advantage for the manual cocking operation. Link 640 is pivotally connected at 643 (FIG. 29) to a connecting link 644 pivotally connected at 645 to a yoke 646 which straddles the return cylinder 624 and is slidable therealong. Pin means connected to the sleeve 618 form pivot 645 and are slidably mounted in slots 647, 648 extending along the return cylinder 624 and sleeve 618.

Figure 30:
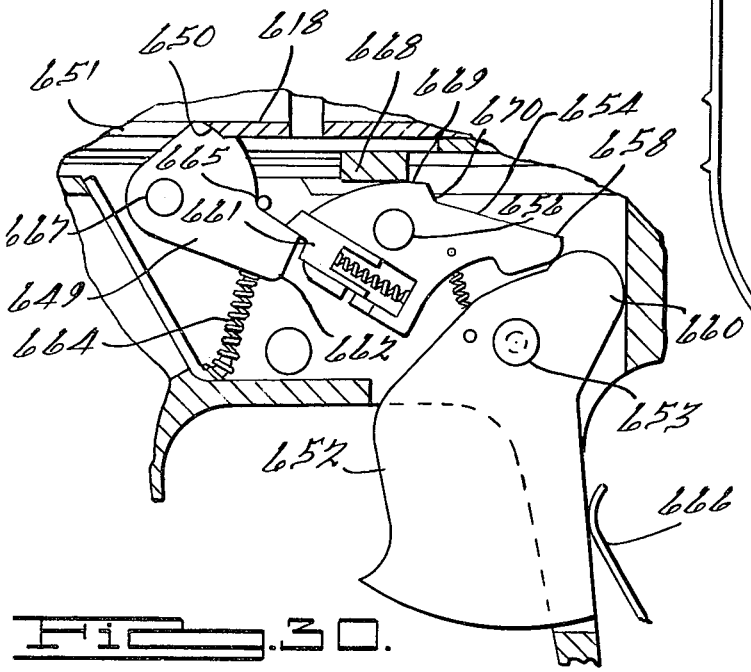
FIG. 30 is an enlarged side elevational view of another portion of the apparatus shown in FIG. 26.

The piston assemblies are held in the cocked position by means of a pivotally mounted sear 649 which is engageable with an abutment 650 in a slot 651 in the sleeve 618 as shown in FIG. 30. A trigger mechanism is provided to release the sear and comprises a trigger 652 pivotally mounted at 653. An intermediate lever 654 is pivoted at 656 and has a cam abutment 658 adapted to engage a cam actuator portion 660 of the trigger. A spring biased cam slide 661 is mounted on the intermediate lever and engages a cam portion 662 of the sear. A sear spring 664 biases the sear toward the latched position against a stop 665. Thus, when the trigger 652 is rotated about 653 against a return spring 666, cam portion 660 rotates lever 654 upwardly about 656 and slide 661 rotates sear 649 downwardly about pivot 667 against spring 664.

A locking mechanism is provided to prevent actuation of the trigger unless the tool has been preconditioned for operation by pressing the barrel assembly against the work surface as will be hereinafter described in detail. A slidable latch bar 668 is engaged with a flat 669 on the intermediate lever 654 in the locked position shown in FIG. 30 and is movable rearwardly to an unlocked position in alignment with the notched portion 670 of the intermediate lever. As shown in detail in FIG. 29, the bar 668 is connected to a sleeve 671 surrounding the bottom of the return cylinder 624 and fastened by a flange 670 to a flange 672 at 673. One end of a slidable sleeve 674, mounted about the barrel 609, is connected to the flange 672 at 675.

Figure 28:
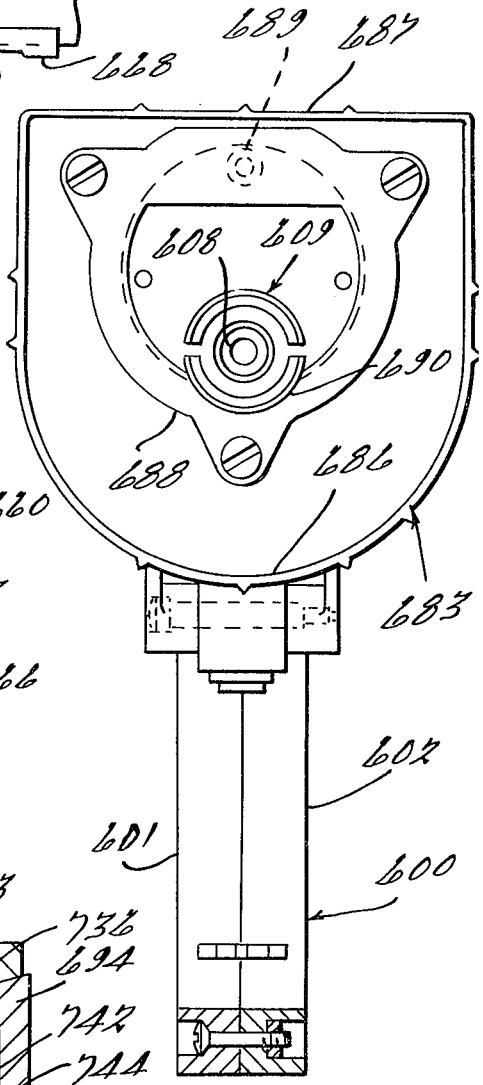
FIG. 28 is an end view of the apparatus shown in FIG. 26.
Figure 31:
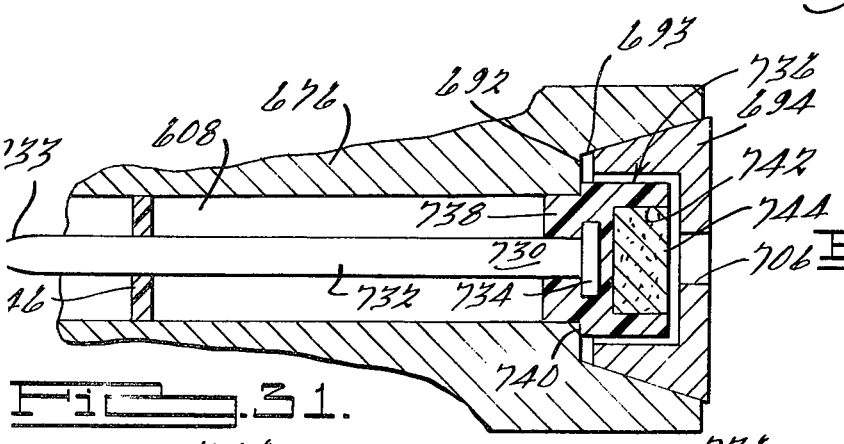
FIG. 31 is an enlarged side elevational view, partly in section, of a portion of the apparatus shown in FIG. 26 with a stud in firing position.

The barrel assembly comprises an elongated tubular member 676 which is reciprocably mounted for movement between a loading position (FIG. 26) and a firing position (FIG. 31). The barrel is slidably journaled in a bore 677 in a housing 678 at the rear of the tool and in a sleeve 679 at the front of the tool. A spring 680, mounted between an abutment in a counterbore in the housing and an abutment formed by the rear end of sleeve 674 and a flange 681 on the barrel 675, biases the barrel forwardly to the loading position. Sleeve 679 is slidably journaled in a collar 682 at the front of the tool and supports a work engaging support shoe means 683. A spring 684 mounted between a stop 685, fixed to the return cylinder 624 biases the sleever 679 and shoe assembly 683 outwardly. As shown in FIG. 28, shoe 683 has a curvilinear portion 686 and a rectangular portion 687 which are adjustably mounted on support plate means 688 by release screw means 689 so that the shoe may be rotated relative to the barrel to accommodate use of the tool in restricted areas such as building corners or the like. A support collar 690 is mounted on the front of the barrel and may include a recess 691 for magnetic reception and retention of washer means or the like to be associated with the driver stud. The other end of the barrel, FIG. 31, is provided with an enlarged obturation chamber 692 having a tapered approach surface 693 adapted to receive a correspondingly tapered portion of an obturator 694 mounted on the breech block assembly 607 as hereinafter described in detail.

Thus, in operation of the tool, the collar 690 is engageable with the work surface and movable rearwardly under pressure applied by the operator against the bias of the compression spring 680. The cup-shaped shoe 683 is also adapted to be seated on a surface surrounding the area of inpact of the stud with the workpiece and is movable rearwardly under pressure against the bias of the compression spring 684. In this manner, the barrel is moved rearwardly to the firing position and the latch bar 668 is moved rearwardly from the latched position to release the trigger mechanism due to the engagement of sleeve 674 with barrel abutment 681. In the firing position, FIG. 31, the compression chamber is connectable to the firing chamber by means of a port 700, valve means 702, valve chamber 704, and a passage 706, as shown in FIG. 26. The valve means comprises a ball valve adapted to be seated on a seat 709 in the movable breech block means 607. Compression spring means 710 and an adjustable plug 711 for varying the tension on the spring may also be provided. Obturator 694 is formed as a plug which also may be threadably mounted or otherwise fixedly secured in the breech block member 607. The outer surface of the obturator 694 is tapered to provide a mating fit with the wall of the enlarged tapered obturator chamber 692 at the end of the barrel means as shown in FIG. 31. Thus, when the barrel is moved rearwardly, the obturator is positioned in the obturator chamber and the tool is ready to be fired.

The breech block is pivotally movable from a position in alignment with the barrel means to a position spaced outwardly therefrom (not shown) to enable a stud to be positioned in the barrel as indicated in FIG. 31. The forward portion 613 of the compression cylinder is utilized to provide shaft means for pivotally mounting the breech block means which is provided with a bore 712 for that purpose. Thus, the breech block is pivotally movable about the central longitudinal axis of the compression cylinder and the piston rod. The breech block is axially located between spaced abutments and extends upwardly between the barrel means and a loading sleeve 714 having a loading port 716 opening at the rear of the tool providing ammunition loading means located adjacent the barrel. A manually operable catch 718 cooperates with spring biased detent means 720 to maintain the movable breech block in the closed firing position.

Figure 32:
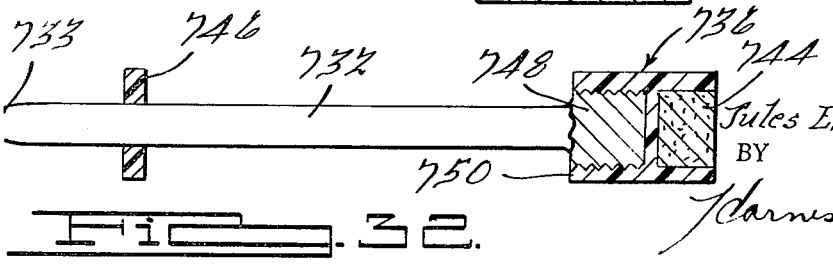
FIG. 32 is an enlarged side elevational view, partly in section, of an alternative form of stud for use with the apparatus of FIG. 26.

Referring again to FIG. 31, the projectile to be driven from the tool may take any of the conventional forms now available for use in tools of this general type. In the illustrative embodiment, the "round of ammunition" 730 comprises a projectile portion in the form of a stud having an elongated shank portion 732, terminating in a pointed end 733, and a headed portion 734. A propellant portion of the "round of ammunition" comprises, in the illustrative embodiment, plug means 736 attached to the projectile head portion and providing support means 738, obturation means 740, and propellant attaching means 742. The plug means may be made of any suitable material, such as plastic materials, which will be capable of being compressed and driven through the barrel after ignition of the propellant. In the illustrative embodiment, the propellant 744 is mounted in a cavity at the rear of the plug with a surface exposed for surface contact with high temperature air delivered through passage 706. It will be understood that the propellant may be otherwise attached or associated with the projectile. Referring now to FIG. 32, an alternative projectile form is shown to comprise a threaded head portion 748 with the plug means 736 being generally cylindrical and molded or extruded onto the threaded head portion as shown. The barrel may be modified as necessary or desirable by, for example, providing an obturation shoulder for engagement with the surface 750 as hereinbefore described in regard to the ammunition shown in FIGS. 9 and 24. It will be understood that any other stud form may be utilized and, as is conventional, a guide ring 746 may be mounted on the front of the studs.

It will be apparent that the aforedescribed tool operates similarly to the aforedescribed gun apparatus. In the firing position, it will be observed that the propellant cap 744 is exposed in the firing chamber for contact with high temperature air to be delivered from the air compression means during firing of the tool while the front edge of the plug 736 also serves to hold the stud in the barrel until the time that the propellant is ignited and the stud is driven down the barrel. It may be observed that the ball valve is mounted to provide a positive reaction surface in the valve chamber so that the gases generated by ignition of the propellant are confined to the firing chamber and communication with the compression chamber is completely closed.

While the propellant is shown to be attached to the stud, it could be separately loaded. Furthermore, while in the illustrative embodiment, a free flight powder actuated tool is disclosed, certain principles of this invention are applicable to a piston driven type tool as will be readily understood by those skilled in the powder actuated tool art.

In the broadest aspects of the present invention it is contemplated that other types of propellant may be used and that other propellant ignition means may also be provided. However, particularly advantageous results are obtained by the use of the particular propellant and the particular means of ignition the propellant disclosed. Obviously, the details of construction and the arrangement of the parts may be varied without departing from the principles herein disclosed. Since the inventive principles disclosed herein have obvious application in alternative combinations, it is intended that the scope of this invention as defined by the appended claims include those alternative embodiments which utilize the inventive principles herein disclosed.

The invention claimed is:

1. An air gun (FIG. 1) comprising a hollow cylinder (40) and a tubular barrel (22) connected to said cylinder in axial alignment therewith, a piston (46,48) slidably mounted in said cylinder, a spring (62) in said cylinder constantly urging said piston forwardly in said cylinder, said piston being movable rearwardly to cocked position, a trigger-operated detent, (76) for releasably retaining said piston in its cocked position, said piston when released being urged by said spring forwardly, a pressure-actuated valve (146) disposed between said cylinder and said barrel, whereby, when said valve is closed, air will be trapped between said piston and said valve and compressed, upon movement of said piston forward, means (148) resiliently holding said valve closed until the pressure of the trapped air has been built up by the piston in its travel to a predetermined air pressure, said resilient holding means thereupon permitting said valve to open, solely under pressure of the compressed air trapped between the said piston and said valve, thereby to permit the compressed air to flow into said barrel against a projectile in said barrel to propel the projectile from the barrel.

2. A firearm such as a rifle or the like having an air ignition system for firing a round of ammunition, said ammunition comprising a projectile and a propellant ignitable by surface contact with high temperature air, said firearm comprising:

receiver means for supporting the operational mechanism of said firearm;

a source of high temperature air for ignition of the propellant by surface contact therewith comprising air compression cylinder means mounted on said receiver means, piston means movably mounted in said cylinder means for movement between a retracted position and an extended position during an air compression stroke, piston driving spring means for driving said piston during a compression stroke;

sear means for latching said piston means in the retracted position;

trigger means for releasing said sear means to initiate a compression stroke;

barrel means mounted on said receiver means and extending parallelly to said compression chamber means for guiding the projectile from said device after ignition of the propellant;

ammunition loading means provided adjacent the rear of said barrel means;

separate movable breech means separate from and movably mounted on said receiver means between said barrel means and said loading means for movement between a firing position in line with said barrel means and a loading position spaced transversely of said barrel means;

obturation means provided on said breech means and being movable therewith;

firing chamber means provided in said breech means within said obturation means by an enlarged chamber adapted to surround the propellant;

high temperature air delivery means connecting said air compression cylinder means to said firing chamber means to deliver high temperature air from said compression cylinder means to said firing chamber means for ignition of the propellant by surface contact therewith;

and flow control means within the firearm associated with said air delivery means permitting flow of high temperature air from said air compression cylinder means to said firing chamber means during a compression stroke and preventing flow of high temperature propellant gases from said firing chamber means to said air compression cylinder means after ignition of said propellant.

3. A firearm such as a rifle or the like having an air ignition system for firing a round of ammunition, said round of ammunition comprising a projectile having a propellant ignitable by surface contact with high temperature air associated therewith, said firearm comprising:

receiver means for supporting the operational mechanism of the firearm;

barrel means having a bore mounted on said receiver means for guiding the projectile from the firearm after ignition of the propellant;

ammunition holding means within said firearm at the rear of said barrel means for holding a projectile and associated propellant in a firing position aligned with said bore in said barrel means;

firing chamber means adapted to receive and surround the propellant portion of the ammunition in the firing position;

a source of high temperature air within the firearm having a temperature at which the propellant is ignitable by surface contact therewith comprising air compression means and piston means movable therein to compress air during an air compression stroke, piston driving spring means associated with said piston means to drive said piston means from a retracted position to an extended position during an air compression stroke;

relatively movable breech means movably mounted in said receiver means at the rear of said barrel means and at least a portion of said breech means being movable between a firing position and a loading position and said breech means connecting said source to said firing chamber means in the firing position;

sear means to latch said piston means in the retracted position;

trigger means to selectively release said sear means to initiate an air compression stroke;

cocking means to move said piston means to the retracted position against the bias of said piston driving spring means;

air delivery means for delivering high temperature air from said air compression means extending through at least a portion of said breech means and terminating in said firing chamber means;

flow control means within the firearm separate from the ammunition permitting flow of high temperature air from said air compression means to said firing chamber means and preventing flow of high temperature fluids from said firing chamber means to said air compression means after ignition of said propellant;

said firing chamber means comprising an area of abutting engagement between said projectile and said ammunition holding means;

an enlarged chamber located rearwardly of the area of abutting engagement between said projectile and said ammunition holding means; and obturation means for confining propellant gases to said firing chamber means formed in part on said ammunition holding means and in part on said air compression means, and being located between said flow control means and said bore in said barrel means.

4. The invention as defined in claim 3 and wherein said enlarged chamber being formed circumjacent said obturation means.

5. The invention as defined in claim 3 and wherein said obturation means comprises a plug member and a plug chamber, said enlarged chamber being formed in said plug member.

6. A firearm such as a rifle or the like having an air ignition system for firing a round of ammunition, said round of ammunition comprising a projectile having a propellant ignitable by surface contact with high temperature air associated therewith, said firearm comprising:

receiver means for supporting the operational mechanism of the firearm;

barrel means having a bore mounted on said receiver means for guiding the projectile from the firearm after ignition of the propellant;

ammunition holding means within said firearm at the rear of said barrel means for holding a projectile and associated propellant in a firing position aligned with said bore in said barrel means;

firing chamber means adapted to receive and surround the propellant portion of the ammunition in the firing position;

a source of high temperature air within the firearm having a temperature at which the propellant is ignitable by surface contact therewith comprising air compression means and piston means movable therein to compress air during an air compression stroke, piston driving spring means associated with said piston means to drive said piston means from a retracted position to an extended position during an air compression stroke;

relatively movable breech means movably mounted in said receiver means at the rear of said barrel means and at least a portion of said breech means being movable between a firing position and a loading position and said breech means connecting said source to said firing chamber means in the firing position;

sear means to latch said piston means in the retracted position;

trigger means to selectively release said sear means to initiate an air compression stroke;

cocking means to move said piston means to the retracted position against the bias of said piston driving spring means;

air delivery means for delivering high temperature air from said air compression means extending through at least a portion of said breech means and terminating in said firing chamber means;

flow control means within the firearm separate from the ammunition permitting flow of high temperature air from said air compression means to said firing chamber means and preventing flow of high temperature fluids from said firing chamber means to said air compression means after ignition of said propellant;

said ammunition holding means comprises bore means having a first portion substantially corresponding in diameter to said bore in the barrel means and to a portion of said projectile; and having a second portion enlarged relative to said first portion and located rearwardly thereof and providing abutment means engageable with an enlarged other portion of said projectile located rearwardly of the first mentioned portion of the projectile.

7. The invention as defined in claim 6 and said bore means being formed in the rear of said barrel means.

8. The invention as defined in claim 6 and said bore means further comprising a third portion enlarged relative to said second portion, and located rearwardly thereof, and surrounding said propellant in spaced relationship thereto.

9. The invention as defined in claim 6 and said bore means being located in breech means connecting said barrel means and said air compression means.

10. The invention as defined in claim 6 and said bore means being located in said movable breech means intermediate said bore in said barrel means and said air compression means.

11. The invention as defined in claim 6 and said bore means being located in said movable breech means intermediate said bore in said barrel means and said air compression means, and means supporting said movable breech means for movement axially of said barrel means.

12. The invention as defined in claim 6 and at least one portion of said movable breech means intermediate said barrel means and said air compression means having said bore means formed therein, and means supporting at least one portion of said movable breech means for axial movement and at least one portion for transverse movement relative to said barrel means.

13. A firearm such as a rifle or the like having an air ignition system for firing a round of ammunition, said round of ammunition comprising a projectile having a propellant ignitable by surface contact with high temperature air associated therewith, said firearm comprising:

receiver means for supporting the operational mechanism of the firearm;

barrel means having a bore mounted on said receiver means for guiding the projectile from the firearm after ignition of the propellant;

ammunition holding means within said firearm at the rear of said barrel means for holding a projectile and associated propellant in a firing position aligned with said bore in said barrel means;

firing chamber means adapted to receive and surround the propellant portion of the ammunition in the firing position;

a source of high temperature air within the firearm having a temperature at which the propellant is ignitable by surface contact therewith comprising air compression means and piston means movable therein to compress air during an air compression stroke, piston driving spring means associated with said piston means to drive said piston means from a retracted position to an extended position during an air compression stroke;

relatively movable breech means movably mounted in said receiver means at the rear of said barrel means and at least a portion of said breech means being movable between a firing position and a loading position and said breech means connecting said source to said firing chamber means in the firing position;

sear means to latch said piston means in the retracted position;

trigger means to selectively release said sear means to initiate an air compression stroke;

cocking means to move said piston means to the retracted position against the bias of said piston driving spring means;

air delivery means for delivering high temperature air from said air compression means extending through at least a portion of said breech means and terminating in said firing chamber means;

flow control means within the firearm separate from the ammunition permitting flow of high temperature air from said air compression means to said firing chamber means and preventing flow of high temperature fluids from said firing chamber means to said air compression means after ignition of said propellant;

said flow control means comprising a valve assembly; and said valve assembly being mounted in at least one portion of said breech means.

14. A firearm such as a rifle of the like having an air ignition system for firing a round of ammunition, said round of ammunition comprising a projectile having a propellant ignitable by surface contact with high temperature air associated therewith, said firearm comprising:

receiver means for supporting the operational mechanism of the firearm;

barrel means having a bore mounted on said receiver means for guiding the projectile from the firearm after ignition of the propellant;

ammunition holding means within said firearm at the rear of said barrel means for holding a projectile and associated propellant in a firing position aligned with said bore in said barrel means;

firing chamber means adapted to receive and surround the propellant portion of the ammunition in the firing position;

a source of high temperature air within the firearm having a temperature at which the propellant is ignitable by surface contact therewith comprising air compression means and piston means movable therein to compress air during an air compression stroke, piston driving spring means associated with said piston means to drive said piston means from a retracted position to an extended position during an air compression stroke;

relatively movable breech means movably mounted in said receiver means at the rear of said barrel means and at least a portion of said breech means being movable between a firing position and a loading position and said breech means connecting said source to said firing chamber means in the firing position;

sear means to latch said piston means in the retracted position;

trigger means to selectively release said sear means to initiate an air compression stroke;

cocking means to move said piston means to the retracted position aganst the bias of said piston driving spring means;

air delivery means for delivering high temperature air from said air compression means extending through at least a portion of said breech means and terminating in said firing chamber means;

flow control means within the firearm separate from the ammunition permitting flow of high temperature air from said air compression means to said firing chamber means and preventing flow of high temperature fluids from said firing chamber means to said air compression means after ignition of said propellant;

at least one portion of said breech means being attached to said air compression means.

15. A firearm having an air ignition system for firing a projectile having an associated propellant capable of being ignited by surface contact with high temperature air comprising:

barrel means for guiding the projectile from within the firearm after ignition of the propellant;

ammunition holding means within the firearm for holding the projectile in a firing position within the firearm;

a source of high temperature air within the firearm having a temperature at which the propellant is ignitable by surface contact therewith;

air delivery means within the firearm for delivering high temperature air from said source to said propellant at a temperature at which the propellant is ignitable by surface contact therewith; and relatively movable breech means within the firearm interposed between said ammunition holding means and said source and being movable relative to said source between a firing position connecting said ammunition holding means to said source and a loading position, a portion of said movable breech means surrounding said propellant in the firing position and defining firing chamber means to which the high temperature air is delivered from said source, and obturation means for confining propellant gases to said firing chamber means formed by another portion of said movable breech means and said ammunition holding means in the firing position.

16. The invention as defined in claim 15 and wherein said oburation means comprises a protruding plug portion and a corresponding cavity portion adapted to matingly receive said plug portion in the firing position.

17. The invention as defined in claim 16 and wherein said plug portion is formed on at least a portion of said movable breech means.

18. The invention as defined in claim 17 and wherein said plug portion comprises a cavity forming part of said firing chamber means and adapted to receive the propellant, an air passage opening into said cavity, and valve means associated with said air passage and being movable between an open position permitting flow of high temperature air to said firing chamber means from said source and a closed position preventing flow of high temperature fluids from said firing chamber means to said source after ignition of said propellant.

19. The invention as defined in claim 18 and having means supporting at least a portion of said breech means for reciprocable movement parallel to said barrel means.

20. A firearm having an air ignition system for firing a projectile having a propellant associated therewith ignitable by surface contact with high temperature air, said firearm comprising:

a source of high temperature air having a temperature at which the propellant is ignitable by surface contact therewith;

barrel means for guiding the projectile from the firearm after ignition of the propellant;

breech means connecting said barrel means to said source;

means supporting at least a portion of said breech means and said barrel means for relative movement between a loading position and a firing position;

obturation means effective between said breech means and said barrel in the firing position, said obturation means comprising an enlarged chamber on one means and a projecting plug on the other means, said chamber and said plug being correspondingly shaped for mating engagement in the firing position;

firing chamber means defined by said chamber and said plug in the firing position and comprising an enlarged chamber surrounding the propellant; and passage means extending from said source through said breech means to said firing chamber means to deliver high temperature air to said firing chamber for ignition of the propellant.

21. The invention as defined in claim 20 and having means supporting at least a portion of said breech means for axial movement parallel to said barrel means.

22. The invention as defined in claim 20 and having means supporting at least a portion of said breech means and said barrel means for axial and transverse movement relative to one another.

23. The invention as defined in claim 20 in which a portion of said breech means is attached to said source, and having means supporting said source and said breech means for movement axially of said barrel means.

24. A firearm having an air ignition system for firing ammunition of the type having a projectile and a propellant attached thereto, said propellant being capable of being ignited by surface contact with high temperature air, said firearm containing separately of said ammunition:

barrel means for guiding the projectile from the apparatus, ammunition holding means within the firearm for holding the ammunition in a firing position within the firearm during ignition of the propellant, including abutment means engageable with the ammunition to hold the ammunition against movement from the firing position until a predetermined shot start force is exerted by the propellant gases after ignition of the propellant firing chamber means within the firearm surrounding said propellant in the firing position, air compression means within the firearm for obtaining high temperature air capable of igniting the propellant in the firing chamber, breech means within the firearm interposed between said barrel means and said air compression means, obturation means provided on said breech means for sealing said firing chamber means, prior to ignition of the propellant and confining the propellant gases to said firing chamber means air delivery means within the firearm for delivering the high temperature air to the firing chamber means from the air compression means for ignition of the propellant by surface contact with the high temperature air, and flow control means within the firearm associated with said air delivery means permitting flow of high temperature air from said air compression cylinder means to said firing chamber during a compression stroke and preventing flow of high temperature propellant gases from said firing chamber to said air compression cylinder means after ignition of said propellant.

25. The invention as defined in claim 24 and having obturation means comprising mating abutment means formed on said barrel means and on said projectile.

26. The invention as defined in claim 24 and said obturation means comprising a shoulder formed on said projectile forwardly of said propellant.

27. The invention as defined in claim 24 and said obturation means comprising a lead seal being formed between said projectile and said barrel means by lead residue on said barrel means and said projectile.

28. The invention as defined in claim 27 and having obturation means for sealing said firing chamber means comprising abutment means between said projectile and said barrel means, and abutment means between said barrel means and said breech means.

29. The invention as defined in claim 28 and said abutment means between said projectile and said barrel means comprising outwardly tapered conical portions.

30. The invention as defined in claim 28 and said abutment means between said barrel means and said breech means comprising a sealing annulus surrounding said firing chamber means.

31. The invention as defined in claim 24 and said obturation means for sealing said firing chamber means comprising plug means and matable chamber means.

32. The invention as defined in claim 31 and said plug means and said matable chamber means being conical, an axially movable member having said matable chamber means formed thereon, and a transversely movable member having said plug means formed thereon, said transversely movable member forming breech means between said firing chamber means and said air compression means, said breech means carrying said valve assembly.

33. The invention as defined in claim 31 and propellant enclosing chamber means formed in said plug means and adapted to receive and surround said propellant in the firing position and define said firing chamber means.

34. The invention as defined in claim 31 and said obturation means being formed by abutting engagement between said projectile and said ammunition holding means and by abutting engagement between said plug means and said matable chamber means.

35. The invention as defined in claim 31 and said obturation means comprising a lead collecting groove provided by said plug means and chamber means between said barrel means and said ammunition holding means to collect lead residue from the lead projectiles during firing, thereby establishing a lead seal between said plug and chamber means.

36. A firearm having an air ignition system for firing ammunition having a projectile and an associated propellant capable of being ignited by surface contact with high temperature air comprising within the firearm and separate from the ammunition:

barrel means having a bore for guiding the projectile from the firearm after ignition of said propellant;

movable ammunition holding means for receiving the projectile and the propellant in a loading position and for carrying the projectile and the propellant from the loading position to the firing position and for holding the projectile and the propellant in a firing position in alignment with said bore in said barrel means prior to ignition of said propellant;

a source of high temperature air having a temperature at which the propellant is ignitable by surface contact therebetween;

firing chamber means formed about the propellant in the firing position;

air delivery means connecting said source to said firing chamber means to deliver high temperature air from said source to said firing chamber at a temperature at which the propellant is ignitable by surface contact therebetween;

obturation means effective in the firing position between the barrel means and the ammunition holding means and between the air delivery means and the ammunition holding means;

valve means associated with said air delivery means to close said firing chamber means relative to said source after delivery of the high temperature air to prevent flow of fluids from the firing chamber to the source after ignition of said propellant;

said obturation means comprising plug means and said valve means being mounted in said plug means.

37. The invention as defined in claim 36 and having a flow control valve in said passage.

38. A firearm having an air ignition system for firing ammunition having a projectile and an associated propellant capable of being ignited by surface contact with high temperature air comprising within the firearm and separate from the ammunition:

barrel means having a bore for guiding the projectile from the firearm after ignition of said propellant;

movable ammunition holding means for receiving the projectile and the propellant in a loading position and for carrying the projectile and the propellant from the loading position to the firing position and for holding the projectile and the propellant in a firing position in alignment with said bore in said barrel means prior to ignition of said propellant;

a source of high temperature air having a temperature at which the propellant is ignitable by surface contact therebetween;

firing chamber means formed about the propellant in the firing position;

air delivery means connecting said source to said firing chamber means to deliver high temperature air from said source to said firing chamber at a temperature at which the propellant is ignitable by surface contact therebetween;

obturation means effective in the firing position between the barrel means and the ammunition holding means and between the air delivery means and the ammunition holding means;

valve means associated with said air delivery means to close said firing chamber means relative to said source after delivery of the high temperature air to prevent flow of fluids from the firing chamber to the source after ignition of said propellant; and movable breech means in said firearm;

said valve means being mounted in said movable breech means.

39. A firearm having an air ignition system for firing ammunition having a projectile and an associated propellant capable of being ignited by surface contact with high temperature air comprising within the firearm and separate from the ammunition:

barrel means having a bore for guiding the projectile from the firearm after ignition of said propellant;

movable ammunition holding means for receiving the projectile and the propellant in a loading position and for carrying the projectile and the propellant from the loading position to the firing position and for holding the projectile and the propellant in a firing position in alignment with said bore in said barrel means prior to ignition of said propellant;

a source of high temperature air having a temperature at which the prolellant is ignitable by surface contact therebetween;

firing chamber means formed about the propellant in the firing position;

air delivery means connecting said source to said firing chamber means to deliver high temperature air from said source to said firing chamber at a temperature at which the propellant is ignitable by surface contact therebetween;

obturation means effective in the firing position between the barrel means and the ammunition holding means and between the air delivery means and the ammunition holding means;

valve means associated with said air delivery means to close said firing chamber means relative to said source after delivery of the high temperature air to prevent flow of fluids from the firing chamber to the source after ignition of said propellant; and means for separating said air compression means from said barrel means for loading ammunition.

40. A firearm having an air ignition system for firing ammunition having a projectile and an associated propellant capable of being ignited by surface contact with high temperature air comprising within the firearm and separate from the ammunition:

barrel means having a bore for guiding the projectile from the firearm after ignition of said propellant;

movable ammunition holding means for receiving the projectile and the propellant in a loading position and for carrying the projectile and the propellant from the loading position to the firing position and for holding the projectile and the propellant in a firing position in alignment with said bore in said barrel means prior to ignition of said propellant;

a souce of high temperature air having a temperature at which the propellant is ignitable by surface contact therebetween;

firing chamber means formed about the propellant in the firing position;

air delivery means connecting said source to said firing chamber means to deliver high temperature air from said source to said firing chamber at a temperature at which the propellant is ignitable by surface contact therebetween;

obturation means effective in the firing position between the barrel means and the ammunition holding means and between the air delivery means and the ammunition holding means;

valve means associated with said air delivery means to close said firing chamber means relative to said source after delivery of the high temperature air to prevent flow of fluids from the firing chamber to the source after ignition of said propellant; and means for separating said air compression means from said barrel means by movement therebetween.

41. A firearm having an air ignition system for firing ammunition having a projectile and an associated propellant capable of being ignited by surface contact with high temperature air comprising within the firearm and separate from the ammunition:

barrel means having a bore for guiding the projectile from the firearm after ignition of said propellant;

movable ammunition holding means for receiving the projectile and the propellant in a loading position and for carrying the projectile and the propellant from the loading position to the firing position and for holding the projectile and the propellant in a firing position in alignment with said bore in said barrel means prior to ignition of said propellant;

a source of high temperature air having a temperature at which the propellant is ignitable by surface contact therebetween;

firing chamber means formed about the propellant in the firing position;

air delivery means connecting said source to said firing chamber means to deliver high temperature air from said source to said firing chamber at a temperature at which the propellant is ignitable by surface contact therebetween;

obturation means effective in the firing position between the barrel means and the ammunition holding means and between the air delivery means and the ammunition holding means, valve means associated with said air delivery means to close said firing chamber means relative to said source after delivery of the high temperature air to prevent flow of fluids from the firing chamber to the source after ignition of said propellant; and means for separating said air compression means from said barrel means by axial movement.

42. A firearm having an air ignition system for firing ammunition having a projectile and an associated propellant capable of being ignited by surface contact with high temperature air comprising within the firearm and separate from the ammunition:

barrel means having a bore for guiding the projectile from the firearm after ignition of said propellant;

movable ammunition holding means for receiving the projectile and the propellant in a loading position and for carrying the projectile and the propellant from the loading position to the firing position and for holding the projectile and the propellant in a firing position in alignment with said bore in said barrel means prior to ignition of said propellant;

a source of high temperature air having a temperature at which the propellant is ignitable by surface contact therebetween;

firing chamber means formed about the propellant in the firing position;

air delivery means connecting said source to said firing chamber means to deliver high temperature air from said source to said firing chamber at a temperature at which the propellant is ignitable by surface contact therebetween;

obturation means effective in the firing position between the barrel means and the ammunition holding means and between the air delivery means and the ammunition holding means;

valve means associated with said air delivery means to close said firing chamber means relative to said source after delivery of the high temperature air to prevent flow of fluids from the firing chamber to the source after ignition of said propellant; and means for separating said air compression means from said barrel means by relative axial movement between said air compression means and said barrel means.

43. A firearm having an air ignition system for firing ammunition having a projectile and an associated propellant capable of being ignited by surface contact with high temperature air comprising within the firearm and separate from the ammunition:

barrel means having a bore for guiding the projectile from the firearm after ignition of said propellant;

movable ammunition holding means for receiving the projectile and the propellant in a loading position and for carrying the projectile and the propellant from the loading position to the firing position and for holding the projectile and the propellant in a firing position in alignment with said bore in said barrel means prior to ignition of said propellant;

a source of high temperature air having a temperature at which the propellant is ignitable by surface contact therebetween;

firing chamber means formed about the propellant in the firing position;

air delivery means connecting said source to said firing chamber means to deliver high temperature air from said source to said firing chamber at a temperature at which the propellant is ignitable by surface contact therebetween;

obturation means effective in the firing position between the barrel means and the ammunition holding means and between the air delivery means and the ammunition holding means;

valve means associated with said air delivery means to close said firing chamber means relative to said source after delivery of the high temperature air to prevent flow of fluids from the firing chamber to the source after ignition of said propellant; and movable breech means intermediate said air compression means and said barrel means; and means for separating said air compression means from said barrel means by movement of said movable breech means intermediate said air compression means and said barrel means.

44. A firearm having an air ignition system for firing ammunition having a projectile and an associated propellant capable of being ignited by surface contact with high temperature air comprising within the firearm and separate from the ammunition:

barrel means having a bore for guiding the projectile from the firearm after ignition of said propellant;

movable ammunition holding means for receiving the projectile and the propellant in a loading position and for carrying the projectile and the propellant from the loading position to the firing position and for holding the projectile and the propellant in a firing position in alignment with said bore in said barrel means prior to ignition of said propellant;

a source of high temperature air having a temperature at which the propellant is ignitable by surface contact therebetween;

firing chamber means formed about the propellant in the firing position;

air delivery means connecting said source to said firing chamber means to deliver high temperature air from said source to said firing chamber at a temperature at which the propellant is ignitable by surface contact therebetween;

obturation means effective in the firing position between the barrel means and the ammunition holding means and between the air delivery means and the ammunition holding means;

valve means associated with said air delivery means to close said firing chamber means relative to said source after delivery of the high temperature air to prevent flow of fluids from the firing chamber to the source after ignition of said propellant; and means for separating said air compression means from said barrel means by movement transverse to the longitudinal axis of said barrel means.

45. A firearm having an air ignition system for firing ammunition having a projectile and an associated propellant capable of being ignited by surface contact with high temperature air comprising within the firearm and separate from the ammunition:

barrel means having a bore for guiding the projectile from the firearm after ignition of said propellant;

movable ammunition holding means for receiving the projectile and the propellant in a loading position and for carrying the projectile and the propellant from the loading position to the firing position and for holding the projectile and the propellant in a firing position in alignment with said bore in said barrel means prior to ignition of said propellant;

a source of high temperature air having a temperature at which the propellant is ignitable by surface contact therebetween;

firing chamber means formed about the propellant in the firing position;

air delivery means connecting said source to said firing chamber means to deliver high temperature air from said source to said firing chamber at a temperature at which the propellant is ignitable by surface contact therebetween;

obturation means effective in the firing position between the barrel means and the ammunition holding means and between the air delivery means and the ammunition holding means;

valve means associated with said air delivery means to close said firing chamber means relative to said source after delivery of the high temperature air to prevent flow of fluids from the firing chamber to the source after ignition of said propellant;

movable breech means intermediate said air compression means and said barrel means; and means for separating said air compression means from said barrel means by relative movement between said air compression means and said barrel means, and by movement of the movable breech means intermediate said air compression means and said barrel means.

46. A firearm having an air ignition system for firing ammunition having a projectile and an associated propellant capable of being ignited by surface contact with high temperature air comprising within the firearm and separate from the ammunition:

barrel means having a bore for guiding the projectile from the firearm after ignition of said propellant;

movable ammunition holding means for receiving the projectile and the propellant in a loading position and for carrying the projectile and the propellant from the loading position to the firing position and for holding the projectile and the propellant in a firing position in alignment with said bore in said barrel means prior to ignition of said propellant;

a source of high temperature air having a temperature at which the propellant is ignitable by surface contact therebetween;

firing chamber means formed about the propellant in the firing position;

air delivery means connecting said source to said firing chamber means to deliver high temperature air from said source to said firing chamber at a temperature at which the propellant is ignitable by surface contact therebetween;

obturation means effective in the firing position between the barrel means and the ammunition holding means and between the air delivery means and the ammunition holding means;

valve means associated with said air delivery means to close said firing chamber means relative to said source after delivery of the high temperature air to prevent flow of fluids from the firing chamber to the source after ignition of said propellant;

movable breech means intermediate said air compression means and said barrel means; and means for separating said air compression means from said barrel means by axial movement between said air compression means and said barrel means, and by movement of said movable breech means intermediate said air compression means and said barrel means.

47. A device for firing a projectile from a firing position comprising:

a barrel for guiding the projectile from the device, firing means operatively associated with the projectile in the firing position and being operative to fire the projectile through the barrel and being mounted in spaced relationship to the barrel, said firing means comprising an air cylinder and a firing chamber and an air flow passage connecting said cylinder to said firing chamber, one of said barrel and said firing means being axially movable relative to the other between a firing position and a loading position, a separate movable connecting member mounted between and in line with said barrel and said firing means and connecting said barrel to said firing means in the firing position, and means for moving said member transversely between the firing position in line with said barrel and a loading position spaced outwardly therefrom.

48. A firearm having an air ignition system for firing a projectile having an associated propellant capable of being ignited by surface contact with high temperature air comprising:

barrel means for guiding the projectile from within the firearm after ignition of the propellant;

ammunition holding means within the firearm for holding the projectile in a firing position within the firearm;

air compression cylinder means providing a source of high temperature air by which the propellant is ignitable by surface contact therewith;

mounting means supporting said compression cylinder means for axial movement relative to said barrel means between a loading position and a firing position;

firing chamber means to which the high temperature air is delivered from said source;

mating plug means and cavity means located between said compression cylinder means and said barrel means and being relatively movable between a firing position and a loading position as said compression cylinder means moves between the loading position and the firing position, said plug means and cavity means being cooperable with said ammunition holding means in the firing position to define said firing chamber means and surrounding said propellant;

an air passage opening into said firing chamber means and being connected to said air compression cylinder means to deliver the high temperature air;

valve means associated with said air passage and being movable between an open position permitting flow of high temperature air to said firing chamber means from said source and a closed position preventing flow of high temperature propellant gases from said firing chamber means to said source after ignition of said propellant; and an obturation means cooperable with said plug means in the firing position to confine propellant gases to said firing chamber means.

* * * * *